US010850819B2

(12) United States Patent
Wiatrowski et al.

(10) Patent No.: US 10,850,819 B2
(45) Date of Patent: Dec. 1, 2020

(54) BRACKET ASSEMBLY FOR A MARINE OUTBOARD MOTOR

(71) Applicant: BRP US INC., Sturtevant, WI (US)

(72) Inventors: Darrell Wiatrowski, Libertyville, IL (US); Mark Whiteside, Zion, IL (US); Benjamin J. Jones, Saint Francis, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 16/263,446

(22) Filed: Jan. 31, 2019

(65) Prior Publication Data

US 2019/0233074 A1 Aug. 1, 2019

Related U.S. Application Data

(60) Provisional application No. 62/624,350, filed on Jan. 31, 2018.

(51) Int. Cl.
*B63H 20/00* (2006.01)
*B63H 20/06* (2006.01)

(52) U.S. Cl.
CPC ..... *B63H 20/06* (2013.01)

(58) Field of Classification Search
CPC ..... B63H 20/10; B63H 20/12; B63H 21/265; F02B 61/045
USPC ..... 248/640, 641, 642, 643
See application file for complete search history.

(56) References Cited

U.S. PATENT DOCUMENTS 4,306,703 A * 12/1981 Finze ..... B63H 20/10 248/642
4,384,856 A * 5/1983 Hall ..... B63H 20/10 248/642
4,842,559 A * 6/1989 Litjens ..... B63H 21/265 440/1
5,151,058 A * 9/1992 Tahara ..... B63H 20/10 248/642
5,664,976 A * 9/1997 Mishima ..... B63H 20/02 440/52
5,782,662 A * 7/1998 Icenogle ..... B63H 20/106 248/641
5,868,591 A * 2/1999 Kleeman ..... B63H 20/00 114/172
5,888,108 A * 3/1999 Iriono ..... B63H 5/10 416/134 R
5,888,109 A * 3/1999 Poll ..... B63H 20/10 248/640
8,840,439 B1 9/2014 Wiatrowski et al.
8,851,944 B1 10/2014 Wiatrowski
(Continued)

*Primary Examiner* — Steven M Marsh
(74) *Attorney, Agent, or Firm* — BCF LLP

(57) ABSTRACT

A bracket assembly for a marine outboard motor has a stern bracket, a swivel bracket pivotably connected to the stern bracket to pivot relative to the stern bracket about a tilt axis, a motor mount pivotably connected to the swivel bracket to pivot relative to the swivel bracket about a steering axis, a steering lock bracket operatively connected to the motor mount and being pivotable with the motor mount relative to the swivel bracket about the steering axis, and a locking member. The locking member is one of: a) movably connected to the swivel bracket to move between a locked and an unlocked positions, and b) removably connected to both the swivel bracket and the steering lock bracket to prevent or limit pivoting of the motor mount about the steering axis.

20 Claims, 20 Drawing Sheets

(56) References Cited

U.S. PATENT DOCUMENTS

| | | | | |
|---|---|---|---|---|
| 8,858,279 | B1 | 10/2014 | Wiatrowski | |
| 9,499,247 | B1 | 11/2016 | Wiatrowski et al. | |
| 9,540,088 | B1 | 1/2017 | French | |
| 2002/0193021 | A1* | 12/2002 | Kokubo | B63H 20/10<br>440/53 |
| 2005/0090164 | A1* | 4/2005 | Saito | B63H 20/08<br>440/53 |
| 2008/0200080 | A1* | 8/2008 | Mizutani | B63H 20/12<br>440/59 |
| 2012/0298833 | A1* | 11/2012 | Witte | B63H 20/06<br>248/640 |

* cited by examiner

10

BRACKET ASSEMBLY FOR A MARINE OUTBOARD MOTOR

CROSS-REFERENCE

The present application claims priority to U.S. Provisional Patent Application No. 62/624,350 filed Jan. 31, 2018, entitled "BRACKET ASSEMBLY FOR A MARINE OUTBOARD MOTOR", which application is incorporated herein by reference in its entirety.

TECHNICAL FIELD

The present technology relates to bracket assemblies for marine outboard motors.

BACKGROUND

Some marine outboard motors are provided with hydraulic power steering systems. Some marine outboard motors also allow to tilt and/or trim a marine outboard motor upward about a tilt/trim axis. Marine outboard motors are often "tilted up", that is to say raised to an upper limit of their tilt range when not in use. This, for example, could be done to raise a marine outboard motor out of water when moored at a dock or to increase ground clearance when a watercraft to which the marine outboard motor is attached is on a trailer. In this position, with the steering axis being tilted, the marine outboard motor's center of gravity is typically above the steering axis. In at least some such cases, and depending on the steering position of the marine outboard motor for example, the weight of the marine outboard motor applies a torque clockwise or counter-clockwise about the steering axis. Typically, components of the hydraulic power steering system are arranged to hydraulically block the marine outboard motor in position when not being steered by an operator such that the marine outboard motor will not pivot about the steering axis when tilted up. However, when a marine outboard motor is "tilted up" for an extended period of time, hydraulic power steering components may internally leak hydraulic fluid and this may cause the marine outboard motor to pivot downward about the steering axis. This is especially inconvenient for multi-engine watercraft.

SUMMARY

It is an object of the present technology to ameliorate at least some of the inconveniences present in the prior art.

According to one aspect of the present technology, there is provided a bracket assembly for a marine outboard motor, the marine outboard motor having a motor assembly and a propulsion unit operatively connected to the motor assembly to be driven by the motor assembly, the bracket assembly including: a) a stern bracket adapted for mounting the marine outboard motor to a stern of a watercraft; b) a swivel bracket pivotably connected to the stern bracket to pivot relative to the stern bracket about a tilt axis; c) a motor mount pivotably connected to the swivel bracket to pivot relative to the swivel bracket about a steering axis, the motor mount being adapted to connect to the motor assembly; d) a steering lock bracket operatively connected to the motor mount and being pivotable with the motor mount relative to the swivel bracket about the steering axis; and e) a locking member. The locking member is one of: i) movably connected to the swivel bracket to move relative to the swivel bracket between an unlocked position and a locked position, the locking member in the unlocked position being positioned relative to the steering lock bracket so as to allow the motor mount to pivot about the steering axis, the locking member in the locked position cooperating with the steering lock bracket to prevent or limit pivoting of the motor mount about the steering axis, and ii) removably connected to both the swivel bracket and the steering lock bracket to prevent or limit pivoting of the motor mount about the steering axis, the locking member when removed from at least the swivel bracket allowing pivoting of the motor mount about the steering axis.

In some embodiments, the locking member is removably connected to both the swivel bracket and the steering lock bracket to prevent or limit pivoting of the motor mount about the steering axis; and the locking member is a locking pin received in both: an aperture defined in the steering lock bracket, and an aperture defined in a part of the swivel bracket.

In some embodiments, the part of the swivel bracket is a pin-receiving member removably connected to another part of the swivel bracket.

In some embodiments, the pin-receiving member is threaded into a corresponding threaded recess defined in the other part of the swivel bracket.

In some embodiments, the locking pin includes an auxiliary locking member removably engaging the pin-receiving member when the auxiliary locking member is received in the aperture of the pin-receiving member.

In some embodiments, the pin-receiving member is disposed on one of a right side and a left side of a vertical longitudinal center plane of the bracket assembly and the steering lock bracket is disposed at least in part above the pin-receiving member when the motor mount is in a straight-ahead steering position.

In some embodiments, the locking member is a lever; and the lever is pivotably connected to the swivel bracket to pivot relative to the swivel bracket about a lever axis between the unlocked position and the locked position.

In some embodiments, the bracket assembly further includes a lever guide defining a lever guide surface, the lever guide being connected to the swivel bracket. In some such embodiments, the lever contacts the lever guide surface when in the locked position; the lever contacts the lever guide surface when in the unlocked position; and the lever guide surface defines limits of pivoting of the lever about the lever axis.

In some embodiments, the lever guide is disposed between the lever axis and the steering axis.

In some embodiments, the lever guide surface defines the locked position and the unlocked position of the lever relative to the lever axis.

In some embodiments, the lever guide surface defines a first recess, a second recess spaced from the first recess and a crest disposed between the first and second recesses, the crest extending toward the pivot axis; the lever is received in the first recess when the lever is in the unlocked position; and the lever is received in the second recess when the lever is in the locked position.

In some embodiments, the lever axis is one of parallel to and coaxial with the tilt axis.

In some embodiments, the motor mount is an upper motor mount; and the bracket assembly further comprises a lower motor mount, the upper and lower motor mounts combining to connect to the motor assembly.

In some embodiments, the lever defines a first prong and a second prong; and when the lever is in the locked position the steering lock bracket is disposed between the first and second prongs.

In some embodiments, the bracket assembly further includes a tilt axle extending through the swivel bracket and the stern bracket and defining the tilt axis, the lever being pivotally connected to the tilt axle.

According to another aspect of the present technology, there is provided a bracket assembly for a marine outboard motor, the marine outboard motor having a motor assembly and a propulsion unit operatively connected to the motor assembly to be driven by the motor assembly. The bracket assembly includes: a) a stern bracket adapted for mounting the marine outboard motor to a stern of a watercraft; b) a swivel bracket pivotably connected to the stern bracket to pivot relative to the stern bracket about a tilt axis, the swivel bracket having a first aperture therein; c) a motor mount pivotably connected to the swivel bracket to pivot relative to the swivel bracket about a steering axis, the motor mount being adapted to connect to the motor assembly; d) a steering lock bracket operatively connected to the motor mount and being pivotable with the motor mount relative to the swivel bracket about the steering axis, the steering lock bracket defining a second aperture therethrough, the second aperture aligning with the first aperture when the motor mount is in a straight-ahead steering position; and e) a locking member being removably receivable in the first and second apertures when the second aperture is aligned with the first aperture, the locking member when received in the first and second apertures cooperating with the swivel bracket and the steering lock bracket to prevent or limit pivoting of the motor mount about the steering axis.

In some embodiments, the locking member is a locking pin.

In some embodiments, the swivel bracket includes a pin-receiving member, the pin-receiving member defining the first aperture therein, and the steering lock bracket is disposed at least in part above the pin-receiving member when the motor mount is in the straight-ahead steering position.

In some embodiments, the locking member is a locking pin that includes a second locking member removably engaging the pin-receiving member when the locking pin is received in the aperture of the pin-receiving member.

In some embodiments, the pin-receiving member is disposed on one of a right side and a left side of a vertical longitudinal center plane of the bracket assembly and the first and second apertures are aligned when the motor mount is in a straight-ahead steering position.

According to another aspect of the present technology, there is provided a bracket assembly for a marine outboard motor, the marine outboard motor having a motor assembly and a propulsion unit operatively connected to the motor assembly to be driven by the motor assembly, the bracket assembly including: a) a stern bracket adapted for mounting the marine outboard motor to a stern of a watercraft; b) a swivel bracket pivotably connected to the stern bracket to pivot relative to the stern bracket about a tilt axis; c) a motor mount pivotably connected to the swivel bracket to pivot relative to the swivel bracket about a steering axis, the motor mount being adapted to connect to the motor assembly; d) a steering lock bracket operatively connected to the motor mount and being pivotable with the motor mount relative to the swivel bracket about the steering axis; and e) a locking member movably connected to the swivel bracket to move relative to the swivel bracket between an unlocked position and a locked position, the locking member in the unlocked position being positioned relative to the steering lock bracket so as to allow the motor mount to pivot about the steering axis, the locking member in the locked position cooperating with the steering lock bracket to prevent or limit pivoting of the motor mount about the steering axis.

In some implementations, the locking member is a lever, and the lever is pivotably connected to the swivel bracket to pivot relative to the swivel bracket about a lever axis between the unlocked position and the locked position.

In some implementations, the bracket assembly further includes a lever guide defining a lever guide surface, the lever guide being connected to the swivel bracket, and wherein: the lever contacts the lever guide surface when in the locked position; the lever contacts the lever guide surface when in the unlocked position; and the lever guide surface defines limits of pivoting of the lever about the lever axis.

In some implementations, the lever guide is disposed between the lever axis and the steering axis.

In some implementations, the lever guide surface defines the locked position and the unlocked position of the lever relative to the lever axis.

In some implementations, the lever guide surface defines a first recess, a second recess spaced from the first recess and a crest disposed between the first and second recesses, the crest extending toward the pivot axis; the lever is received in the first recess when the lever is in the unlocked position; and the lever is received in the second recess when the lever is in the locked position.

In some implementations, the lever includes: a) a body pivotably connected to the swivel bracket to pivot relative to the swivel bracket about the lever axis between the locked position and the unlocked position; b) a contact element supported by the body of the lever, i) the contact element travelling across the lever guide surface when the lever is pivoting between the locked position and the unlocked position, ii) the contact element being received in the first recess when the lever is in the unlocked position, and iii) the contact element being received in the first recess when the lever is in the locked position; and c) a biasing member biasing the contact element against the lever guide surface.

In some implementations, the contact element is a rolling element rotationally supported by the body of the lever.

In some implementations, the lever further includes a rolling element receiving body defining a socket on a first side thereof; the rolling element is received in part in the socket; and the biasing member is positioned between the body of the lever and a second side of the rolling element receiving body, the second side being opposite the first side.

In some implementations, the body of the lever defines a passage therein; and the rolling element receiving body is slidably received in the passage.

In some implementations, the lever axis is parallel to the tilt axis.

In some implementations, the lever axis is coaxial with the tilt axis.

In some implementations, the steering lock bracket extends away from the motor mount in a direction opposite a side of the motor mount adapted to connect to the motor assembly.

In some implementations, the motor mount is an upper motor mount; and the bracket assembly further comprises a lower motor mount, the upper and lower motor mounts combining to connect to the motor assembly.

In some implementations, the lever defines a first prong and a second prong; and when the lever is in the locked position the steering lock bracket is disposed between the first and second prongs.

In some implementations, the first prong and the second prong are positioned symmetrically relative to a longitudinal centerline of the lever.

In some implementations, the lever is positioned between a left side of the swivel bracket and a right side of the swivel bracket.

In some implementations, the bracket assembly further includes a tilt axle extending through the swivel bracket and the stern bracket and defining the tilt axis, the lever being pivotally connected to the tilt axle.

In some implementations, the swivel bracket pivots about the tilt axle.

According to another aspect of the present technology, there is provided a bracket assembly for a marine outboard motor, the marine outboard motor having a motor assembly and a propulsion unit operatively connected to the motor assembly to be driven by the motor assembly, the bracket assembly comprising: a) a stern bracket adapted for mounting the marine outboard motor to a stern of a watercraft; b) a swivel bracket pivotably connected to the stern bracket to pivot relative to the stern bracket about a tilt axis; c) a motor mount pivotably connected to the swivel bracket to pivot relative to the swivel bracket about a steering axis, the motor mount being adapted to connect to the motor assembly; d) a first steering lock bracket operatively connected to the motor mount and being pivotable with the motor mount relative to the swivel bracket about the steering axis, the first steering lock bracket defining a first aperture therethrough; e) a second steering lock bracket operatively connected to the swivel bracket, the second steering lock bracket defining a second aperture therethrough, the second aperture aligning with the first aperture when the motor mount is in a straight-ahead steering position; and f) a locking member being removably receivable in the first and second apertures when the second aperture is aligned with the first aperture, the locking member when received in the first and second apertures cooperating with the first and second steering lock brackets to prevent or limit pivoting of the motor mount about the steering axis.

In some implementations, the locking member is a locking pin.

In some implementations, the first steering lock bracket is disposed at least in part above the second steering lock bracket when the motor mount is in the straight-ahead steering position.

For purposes of this application, terms related to spatial orientation such as forward, rearward, upward, downward, left, and right, should be understood in a frame of reference where the propeller position corresponds to a rear of the marine outboard motor and a driveshaft of the marine outboard motor is vertical. Terms related to spatial orientation when describing or referring to components or sub-assemblies of the marine outboard motor separately from the marine outboard motor should be understood as they would be understood when these components or sub-assemblies are mounted to the marine outboard motor, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
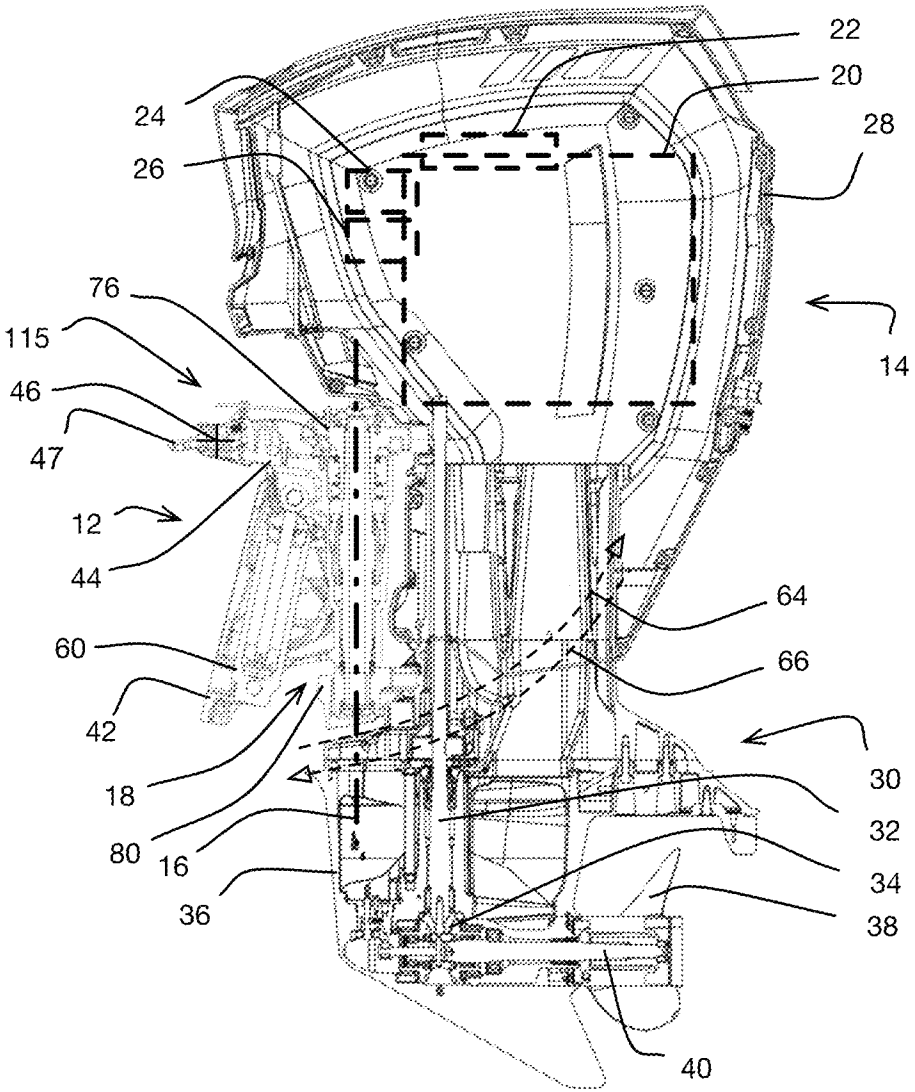
FIG. 1 is a left side elevation view of a cross-section of a marine outboard motor including a steering lock system, taken through a vertical longitudinal center plane thereof, with a motor assembly and some other components of the marine outboard motor shown schematically in dotted lines.

With reference to FIG. 1, a marine outboard motor 10 includes a bracket assembly 12 for mounting the marine outboard motor 10 to a watercraft, a motor assembly 14 pivotably mounted to the bracket assembly 12 about a steering axis 16, and a power steering system 18 for pivoting the motor assembly 14 about the steering axis 16. The motor assembly 14 is shown in an upright position in FIG. 1.

As shown schematically in FIG. 1, the motor assembly 14 includes a motor 20 and a magneto 22 driven by the motor 20. The marine outboard motor 10 further includes a combination of electric and manual starters 24, and a engine management module (EMM) 26. It is contemplated that only a manual starter, or only an electric starter, could be used to start the motor 20. The EMM 26 is electronically connected to the motor 20 and controls operation of the motor 20. The magneto 22 generates power (in the present implementation, 20 amperes at 55 volts) to be supplied to the EMM 26 and charge a battery that is used to run the electric starter 24. A power management module within the EMM 26 transforms this power supply into different voltages that are then distributed to and power the electronic components of the marine outboard motor 10. It is contemplated that the marine outboard motor 10 could have any other suitable electronic system.

The motor 20 and the EMM 26 are surrounded and protected by a cowling 28. In the present implementation, the motor 20 is a two-stroke gasoline powered internal combustion engine. It is contemplated that the motor 20 could be any type of motor, including a four-stroke internal combustion engine and/or an electric motor. It is contemplated that the EMM 26 could be a different type of controller, depending on each particular type of motor 20 for example. For example, where the motor 20 is an electric motor, an electric engine management module could be used to control operation of the electric motor and other elements associated with the marine outboard motor 10.

The marine outboard motor 10 further includes a propulsion unit 30. The propulsion unit 30 is connected at a bottom of the motor assembly 14. The propulsion unit 30 includes a driveshaft 32 and a transmission 34. The driveshaft 32 is operatively connected at its upper end to the motor 20 to be driven by the motor 20. The driveshaft 32 extends downward from the motor 20 to the transmission 34 housed in a gearcase 36 of the propulsion unit 30. The transmission 34 is connected to the bottom end of the driveshaft 32.

The propulsion unit 30 further includes a propeller 38 supported on a propeller shaft 40. The propeller shaft 40 is rotationally supported at a bottom, rear end of the gearcase 36, such that the propeller 38 extends rearward from the propulsion unit 30 for propelling the marine outboard motor 10. The transmission 34 operatively connects the bottom end of the driveshaft 32 to the propeller shaft 40 to selectively drive the propeller 38 to propel the marine outboard motor 10.

The transmission 34 has a forward gear for propelling the marine outboard motor 10 forward, a neutral gear in which the transmission 34 decouples the propeller shaft 40 from the driveshaft 32, and a reverse gear for propelling the marine outboard motor 10 rearward. The gears of the transmission 34 are shifted by an electronic gear shift actuator that is operated via the EMM 26. It is contemplated that a different type of transmission 34 could be used, including a mechanically actuated transmission 34, a transmission 34 that has a single forward gear and no other gears, or a transmission 34 that includes forward and neutral gears and no reverse gear. It is also contemplated that a different propulsion unit 30, such as a jet drive for example, could be used.

Figure 2:
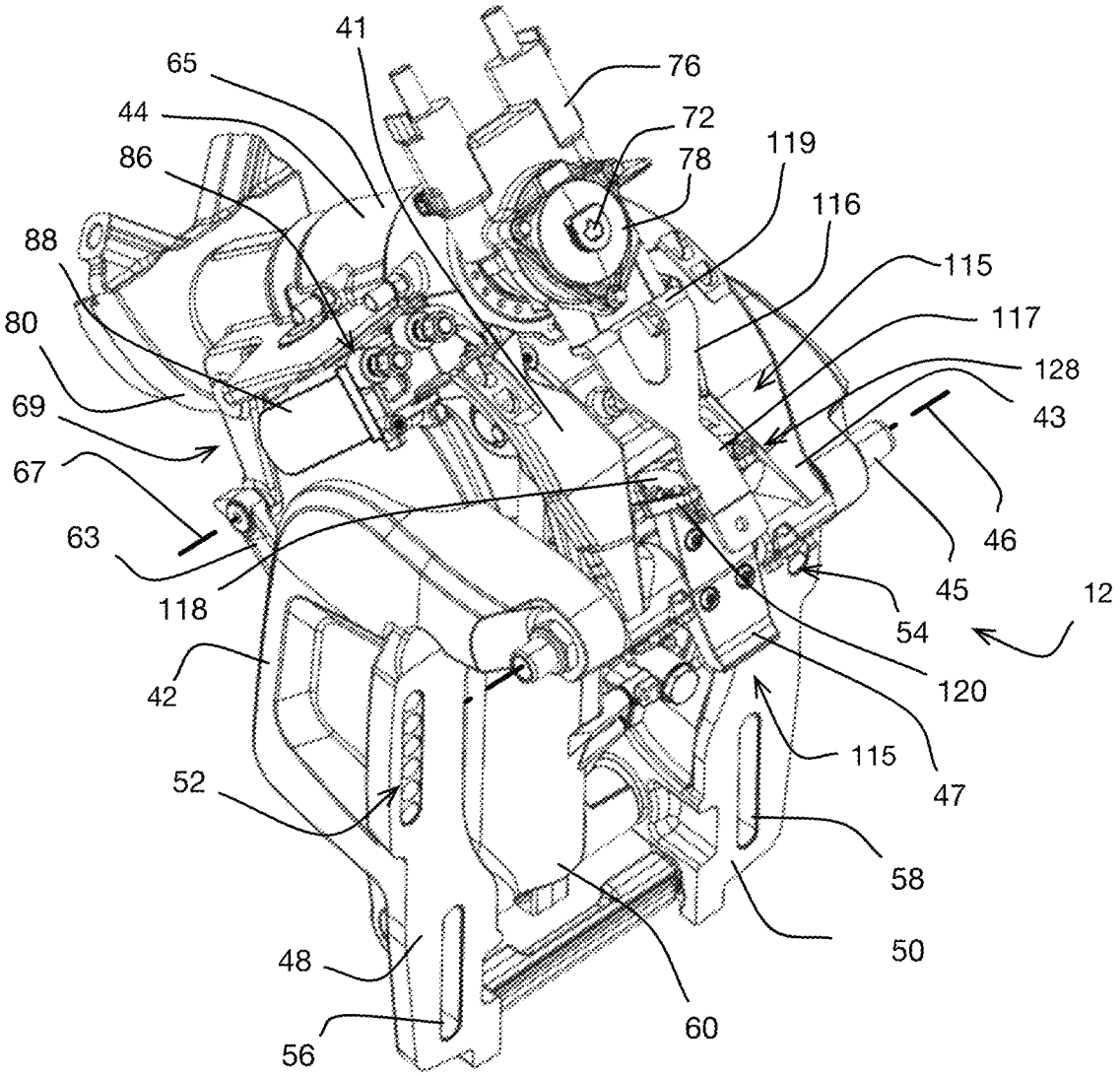
FIG. 2 is a perspective view taken from a front, right, top side of a bracket assembly of the marine outboard motor of FIG. 1 in a tilted up position, the bracket assembly including the steering lock system.
Figure 3:
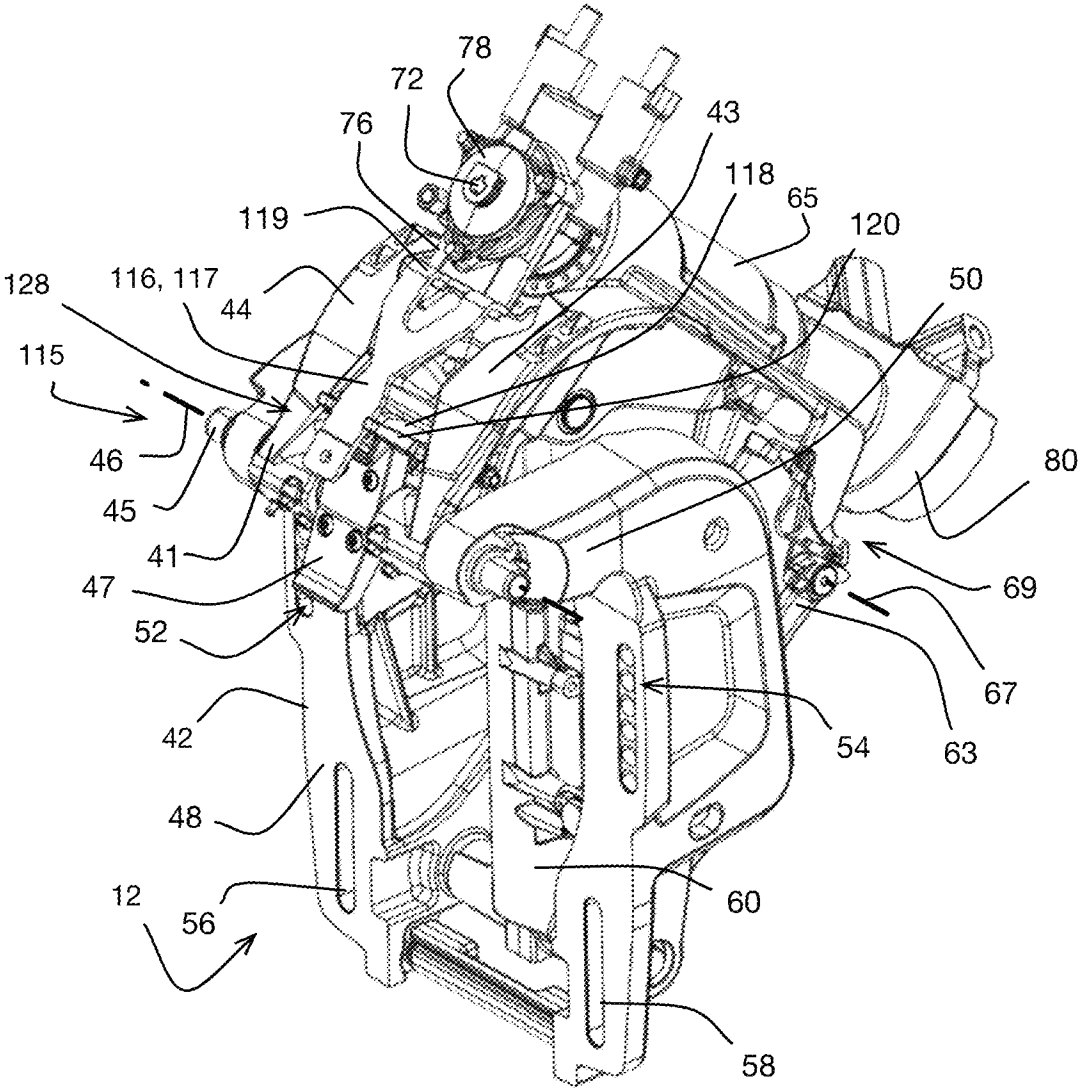
FIG. 3 is a perspective view taken from a front, left, top side of the bracket assembly of FIG. 2.
Figure 4:
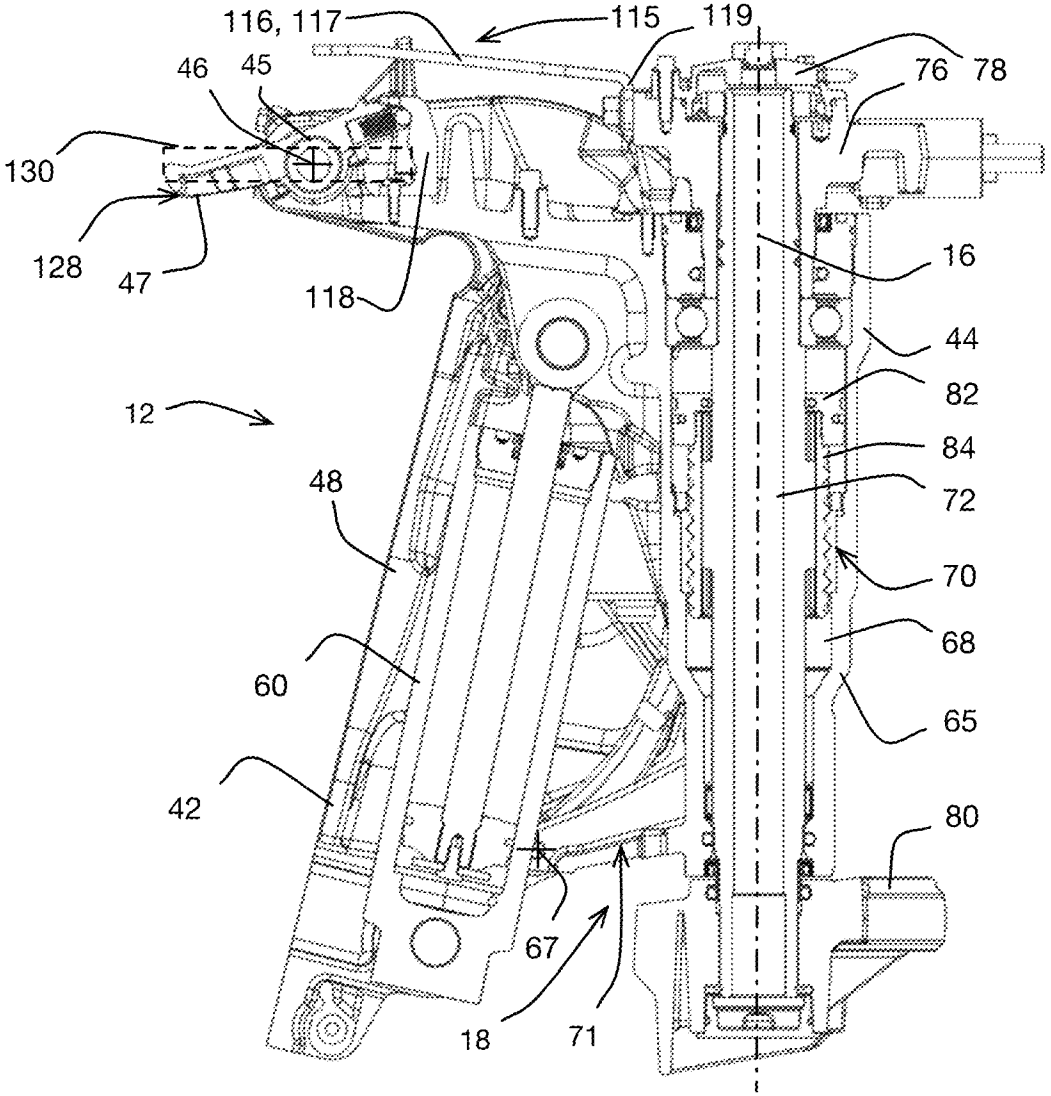
FIG. 4 is a left side elevation view of a cross-section of the bracket assembly of FIG. 2 taken through a vertical longitudinal center plane thereof, with the bracket assembly in a tilted down position.

The bracket assembly 12 of the marine outboard motor 10 includes a stern bracket 42 and a swivel bracket 44 pivotally connected to the stern bracket 42 to pivot relative to the stern bracket 42 about a tilt/trim axis 46. In the present implementation, as shown in FIGS. 2 to 4, the pivot connection between the swivel bracket 44 and stern bracket 42 is provided by a tilt axle 45 extending through the swivel bracket 44 and the stern bracket 42 and defining the tilt/trim axis 46. To this end, and as best shown in FIGS. 2 and 3, the swivel bracket 44 has two arms 41, 43 extending forward from a rear portion 65 thereof. Each of the arms 41, 43 defines an aperture therethrough and the tilt axle 45 is received through these apertures.

The stern bracket 42 includes two laterally spaced attachment members 48, 50 that contact the stern or other part of the watercraft when the marine outboard motor 10 is mounted to the stern or the other suitable part. Similar to the arms 41, 43 of the swivel bracket 44, each of the attachment members 48, 50 of the stern bracket 42 defines an aperture therethrough and the tilt axle 45 is received through these apertures. In the present implementation, the arms 41, 43 of the swivel bracket 44 are positioned between the attachment members 48, 50. It is contemplated that the tilt axle 45 could be a different type of structural element and could be more than one structural element. In the present implementation, the tilt axle 45 is a metal tube. It is also contemplated that different material(s) and/or manufacturing method(s) could be used.

In the present implementation, the tilt axle 45 is fixed with respect to the attachment members 48, 50 of the stern bracket 42 and the swivel bracket 44 rotates about the tilt axle 45. It is contemplated that in some implementations, the tilt axle 45 could be rotatable in the apertures in the attachment members 48, 50 of the stern bracket 42 and fixed relative to the swivel bracket 44.

A steering lock lever 47 is pivotably mounted onto the tilt axle 45 to pivot about the tilt/trim axis 46 on the tilt axle 45. As shown, the steering lock lever 47 is positioned between the arms 41, 43 of the swivel bracket 44. The steering lock lever 47 will be described in more detail herein below.

The stern bracket 42 is configured for mounting the marine outboard motor 10 to a stern or other part of a watercraft. To this end, two sets of upper mounting apertures 52, 54 and two elongate lower apertures 56, 58 are defined in the attachment members 48, 50. The apertures 52, 54, 56, 58 are sized to receive bolts (not shown) therethrough and are arranged to allow for upward and downward adjustment of the securement position of the stern bracket 42 relative to the stern or the other suitable part. In the case of attachment to a stern of a watercraft for example, bolts are inserted through the stern and corresponding ones of the apertures 52, 54, 56, 58, and through corresponding apertures in the stern, and a nut is threaded onto each of the bolts and tightened to a suitable degree to secure the stern bracket 42, and therefore also the marine outboard motor 10, to the stern. It is contemplated that any other mounting mechanism could be used.

Still referring to FIGS. 1, 2 and 3, a hydraulic tilt/trim linear actuator 60 is pivotably connected at a lower end thereof to the stern bracket 42 and at the upper end thereof to the swivel bracket 44. The tilt/trim linear actuator 60 is fluidly operatively connected to a hydraulic tilt/trim pump. In this implementation, the tilt/trim pump is mounted to the tilt/trim linear actuator 60 and moves with the tilt/trim linear actuator 60 when the tilt/trim linear actuator 60 extends to tilt or trim the swivel bracket 44 upward 64 about the tilt/trim axis 46 or retracts to tilt or trim the swivel bracket 44 downward 66 about the tilt/trim axis 46. In the present implementation, the tilt/trim pump is in electronic communication with the EMM 26 and could be operable by any suitable tilt/trim control switch that could be mounted for example next to a steering wheel of a watercraft with which the marine outboard motor 10 is used and electronically connected to the EMM 26.

The tilt/trim pump adjusts tilt/trim of the motor assembly 14 by extending the tilt/trim linear actuator 60 to pivot the swivel bracket 44 upward 64 relative to the stern bracket 42 about the tilt/trim axis 46 and retracting the tilt/trim linear actuator 60 to pivot the swivel bracket 44 downward 66 relative to the stern bracket 42 about the tilt/trim axis 46. The swivel bracket 44 is shown in a tilted up position in FIGS. 2 and 3, and in a tilted down position in FIGS. 1 and 4. It is contemplated that any other suitable tilt/trim actuator could be used in addition to or instead of the tilt/trim linear actuator 60, for example a hydraulic tilt/trim actuator integrated into the swivel bracket such as that described in U.S. Pat. No. 8,840,439.

As best shown in FIGS. 2 to 3, the marine outboard motor 10 includes a metal tilt lock bracket 63 that is connected to the rear portion 65 of the swivel bracket 44 to pivot about a tilt lock bracket axis 67 between an extended position 69, shown partially in FIGS. 2 and 3, and a folded position 71, shown partially in FIG. 4. The tilt lock bracket 63 is manually pivotable upward and rearward about the tilt lock bracket axis 67 from the extended position 69. When the swivel bracket 44 is tilted up as shown in FIGS. 2 and 3, the tilt lock bracket 63 can be manually pivoted from the folded position 71 to the extended position 69 to prevent the swivel bracket 44 from pivoting back down about the tilt/trim axis 46 towards the tilted down position. In this implementation, in the extended position 69 the tilt lock bracket axis 67 abuts against the stern bracket 42 at a location below the tilt/trim axis 46 and thereby acts as a spacer that prevents the swivel bracket 44 from being tilted down about the tilt/trim axis 46. It is contemplated that a different tilt/trim system and/or different tilt/trim controls and/or tilt locking system could be used.

Now referring to FIG. 4, the power steering system 18 will be described in more detail. As shown, the swivel bracket 44 defines a cavity 68 in the rear portion 65 thereof and includes a hydraulic steering actuator 70. The hydraulic steering actuator 70 includes a pivot shaft 72 that extends through the cavity 68 and is pivotably supported by the swivel bracket 44 about the steering axis 16. An upper end of the pivot shaft 72 extends upward out of the cavity 68 and the swivel bracket 44. A lower end of the pivot shaft 72 extends downward out of the cavity 68 and the swivel bracket 44.

An upper motor mount 76 and a steering position sensor 78 are connected to the upper end of the pivot shaft 72. The upper motor mount 76 is fixed to the upper end of the pivot shaft 72 and pivots with the pivot shaft 72. As shown in FIGS. 2 to 4, the upper motor mount 76 extends rearward from the pivot shaft 72 and includes two male mating portions that mate with corresponding female mating portions (not shown) defined in a forward-facing portion of the motor assembly 14. A lower motor mount 80 is fixed to the lower end of the pivot shaft 72 and pivots with the pivot shaft 72. Similar to the upper motor mount 76, the lower motor mount 80 extends rearward from the pivot shaft 72 and connects to the motor assembly 14 in a similar way as the upper motor mount 76.

The pivot shaft 72 is pivotable clockwise and counter-clockwise, when the marine outboard motor 10 is viewed from above, about the steering axis 16 within a predefined pivot range. The motor assembly 14 is connected to both the upper motor mount 76 and the lower motor mount 80 and pivots with the pivot shaft 72 within the pivot range of the pivot shaft 72. It is contemplated that any other mounting system and/or mounting connections could be used to connect the motor assembly 14 to the pivot shaft 72. For example, it is contemplated that a single point, or more than two mounting points, could be used. It is also contemplated that the pivot range could differ depending on each particular implementation and application of the marine outboard motor 10.

As shown in FIG. 4, the hydraulic steering actuator 70 further includes a hydraulically-movable piston 82 and a screw drive 84. Both the piston 82 and the screw drive 84 are disposed inside the cavity 68. The piston 82 is mounted onto the pivot shaft 72 coaxially with the pivot shaft 72 and is movable upward and downward inside the cavity 68 along the pivot shaft 72. The screw drive 84 operatively couples the piston 82 to the pivot shaft 72 and also operatively couples the pivot shaft 72 to the swivel bracket 44 inside the cavity 68 such that upward and downward movement of the piston 82 along the pivot shaft 72 pivots the pivot shaft 72, and therefore also the motor assembly 14, about the steering axis 16.

In the present implementation, movement of the piston 82 upward pivots the pivot shaft 72, and the motor assembly 14, counter-clockwise, when the pivot shaft 72 is viewed from above, about the steering axis 16. Movement of the piston 82 downward pivots the pivot shaft 72, and the motor assembly 14, clockwise about the steering axis 16. It is contemplated that the screw drive 84 could be selected to reverse this steering action such that upward movement of the piston 82 would result in clockwise steering, and downward movement of the piston 82 would result in counter-clockwise steering. It is contemplated that a different coupling mechanism could be used to connect the piston 82 to the pivot shaft 72, instead of or in addition to the screw drive 84.

Figure 5:
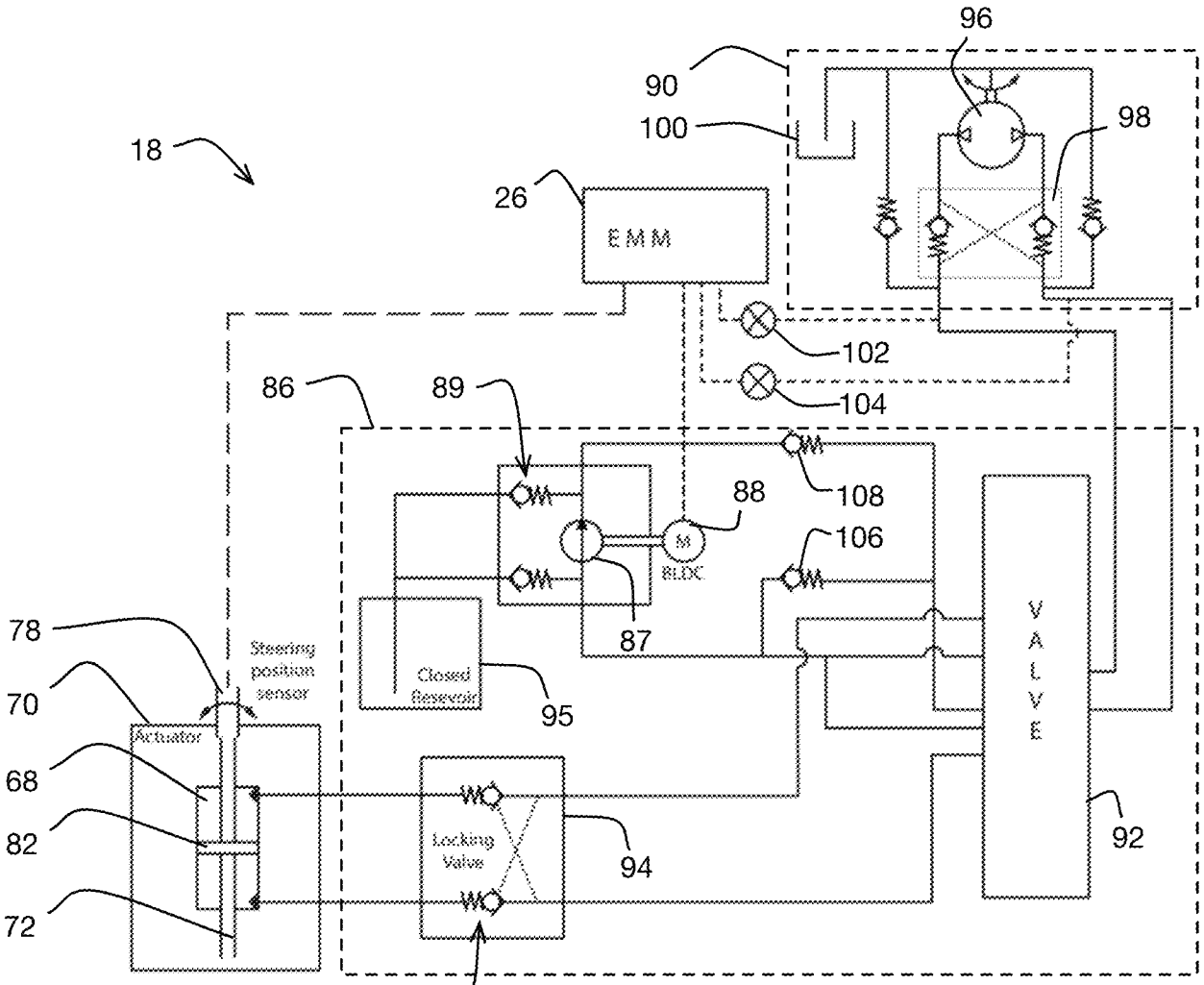
FIG. 5 is a schematic illustration of the power steering system of the marine outboard motor of FIG. 1.

In the implementation shown schematically in FIG. 5, the piston 82 is movable upward and downward along the pivot shaft 72 by a hydraulic power steering assembly 86 and a hydraulic steering assembly 90 of a watercraft onto which the marine outboard motor 10 is provided.

In the present implementation, the hydraulic power steering assembly 86 is mounted to the swivel bracket 44, but a different mounting location could be used, including a mounting location on the watercraft onto which the marine outboard motor 10 is provided. In this implementation, the hydraulic power steering assembly 86 includes a valve assembly 92, a locking valve 94, a hydraulic fluid reservoir 95, and a hydraulic power steering pump 87. The hydraulic power steering pump 87 is driven by a unidirectional brushless direct current motor 88, further referred to as the power steering motor 88.

As shown in FIG. 5, the fluid reservoir 95 is fluidly connected to the hydraulic fluid circuit of the power steering system 18 via a pair of normally-closed ball valves 89 disposed in a fluid distribution manifold of the hydraulic power steering pump 87. The fluid reservoir 95 supplies hydraulic fluid into the hydraulic fluid circuit of the power steering system 18 whenever the amount of hydraulic fluid in the hydraulic fluid circuit is low. When the amount of hydraulic fluid in the hydraulic circuit is low, at least one of the pair of normally-closed ball valves 89 opens as a result of suction created at the at least one of the pair of normally-closed ball valves 89 by the hydraulic power steering pump 87. It is contemplated that a different hydraulic fluid make-up system could be used. It is also contemplated that the fluid make-up system could be omitted.

In this implementation, the power steering motor 88 is integrated into a body of the hydraulic power steering assembly 86. It is contemplated that a different power steering motor 88 could be used. As can be seen in FIG. 5, the power steering motor 88 is in electronic communication with and is operated via the EMM 26 to assist an operator in steering the marine outboard motor 10.

When the marine outboard motor 10 is installed onto a watercraft, the valve assembly 92 selectively hydraulically connects the hydraulic steering assembly 90 of the watercraft to the hydraulic power steering pump 87 and to the hydraulic steering actuator 70. The hydraulic steering assembly 90 includes a hydraulic pump 96 operated by a steering wheel of the watercraft, a locking valve 98, and a hydraulic fluid reservoir 100. The hydraulic fluid reservoir 100 is similar to the hydraulic fluid reservoir 95 and as such will not be described in more detail herein. It is contemplated that only one of the two hydraulic fluid reservoirs 95, 100 could be provided and that one or both could be located elsewhere than as shown in the illustrated implementation.

In the present implementation, when the steering wheel of the watercraft is turned by an operator of the watercraft, the hydraulic pump 96 pumps hydraulic fluid through a corresponding port of the locking valve 98 to a corresponding port of the valve assembly 92 and thereby moves the valve assembly 92 into a position for causing steering of the marine outboard motor 10 in a corresponding direction. From the valve assembly 92, hydraulic fluid flows to a corresponding port of the locking valve 94, as will be described in more detail below, into the cavity 68 of the hydraulic actuator 70 on a corresponding side of the piston 82 to move the piston 82 along the pivot shaft 72 and to thereby pivot the pivot shaft 72, and the motor assembly 14, about the steering axis 16 in the corresponding direction. Hydraulic fluid displaced from the cavity 68 on the other side of the piston 82 by the movement of the piston 82 flows through the other port of the locking valve 94, then through the valve assembly 92 and back to the hydraulic pump 96.

The EMM 26 monitors the pressure of hydraulic fluid in the lines connecting the valve assembly 92 to the locking valve 98 via two pressure sensors 102, 104.

When the difference between the pressures sensed by the two pressure sensor 102, 104 is below a pre-determined threshold, the EMM 26 does not operate the motor 88 and therefore the hydraulic power steering pump 87 is inactive. As a result, the hydraulic fluid flows from the valve assembly 92 toward the hydraulic power steering pump 87 but by-passes the hydraulic power steering pump 87 via a normally-closed by-pass valve 106. From the by-pass valve 106, the hydraulic fluid flows back to the valve assembly 92 and then from the valve assembly 92 to the locking valve 97 and the cavity 68 of the hydraulic steering actuator 70 as described above.

When the difference between the pressures sensed by the two pressure sensor 102, 104 is above the pre-determined threshold, the EMM 26 operates the motor 88 and thereby runs the hydraulic power steering pump 87. As a result, the hydraulic fluid flows from the valve assembly 92 toward the hydraulic power steering pump 87, flows through the hydraulic power steering pump 87 and returns to the valve assembly 92 via a normally-closed valve 108. From the valve assembly 92, the hydraulic fluid then flows to the locking valve 94 and the cavity 68 of the hydraulic steering actuator 70 as described above. The hydraulic power steering pump 87 boosts the pressure generated by the hydraulic pump 96 of the hydraulic steering assembly 90 and thereby provides steering assistance to the operator.

A similar steering system is described in U.S. Pat. No. 9,499,247, granted on Nov. 22, 2016, entitled "Marine Outboard Engine Having a Tilt/Trim and Steering Bracket Assembly", the entirety of which is incorporated herein by reference. It is contemplated that a different steering system, such as a powered or a manually-operated tiller system, could be used instead of the power steering system 18.

The locking valve 94 of the hydraulic power steering assembly 86 has two normally-closed ball valves 99. When no hydraulic fluid is being supplied to the hydraulic steering actuator 70 by the hydraulic pump 96 or the hydraulic power steering pump 87, both of the normally-closed ball valves 99 of the locking valve 94 close. Closure of both of these normally-closed ball valves 99 prevents hydraulic fluid from flowing out of the cavity 68 either above or below the piston 82. This hydraulically locks the piston 82 in the cavity 68 and thereby prevents the pivot shaft 72 from pivoting about the steering axis 16. This, in turn, prevents steering of the marine outboard motor 10.

For example, when the swivel bracket 44 is tilted upward as shown in FIGS. 2 and 3, the hydraulic power steering pump 87 is shut off and no force is applied to the steering wheel of the watercraft by an operator, the hydraulic lock on the pivot shaft 72 prevents the pivot shaft 72, and therefore the motor assembly 14, from pivoting about the steering axis 16.

While the steering systems described herein above are suitable for their purposes, as previously described, a small amounts of internal leakage can occur across hydraulic components such as the locking valves, the spool valves and the like. Such internal leakage may not be noticeable or significant during normal operation, but when a marine outboard motor such as the marine outboard motor 10 described herein is kept in a tilted up position for long periods of time this internal leakage can result in the marine outboard motor to no longer be hydraulically locked in position.

Now referring to FIGS. 1 to 4 and 6 to 11, a steering lock system 115 of the marine outboard motor 10 will be described. In the present implementation, the steering lock system 115 is manually operated and includes a steering lock bracket 116, a lever guide 118, and the steering lock lever 47. As will be described in more detail herein below, the steering lock lever 47 is movable to a locked position 128 in which it cooperates with the steering lock bracket 116 and the lever guide 118 to prevent or limit pivoting of the upper and lower motor mounts 76, 80 about the steering axis 16, and therefore preventing or limiting pivoting of the motor assembly 14 about the steering axis 16. The steering lock lever 47, when in the locked position, limits or prevents such pivoting about the steering axis 16, which pivoting may otherwise occur due to an internal leakage across hydraulic components such as the locking valve 94, failure of a hydraulic component, or a loss of hydraulic fluid in the power steering system 18 for example. The steering lock can prove practical when the swivel bracket 44 is tilted up.

The steering lock bracket 116 is best shown in FIGS. 2 to 4. The steering lock bracket 116 is operatively connected to the upper motor mount 76 such that it is pivotable with the upper motor mount 76, and therefore with the motor assembly 14, about the steering axis 16. In the present implementation, the steering lock bracket 116 is fixed at its rear end to the upper motor mount 76 and is pivotable with the upper motor mount 76. In the present implementation, the steering lock bracket 116 has an elongate portion 117 and an attachment portion 119 at a rear end of the elongate portion 117. The elongate portion 117 extends forward from the upper motor mount 76 when the motor assembly 14 is steered in a straight-forward steering position. The attachment portion 119 extends downward from the elongate portion 117 when the motor assembly 14 is in the upright position. As best shown in FIG. 4, the attachment portion 119 is bolted to a front side of the upper motor mount 76. It is contemplated that a different kind attachment could be used and that the steering lock bracket 116 could be indirectly connected to the upper motor mount 76.

In the present implementation, the elongate portion 117 and the attachment portion 119 of the steering lock bracket 116 are made from a single piece of metal that is stamped and formed to the shape shown in the figures. It is contemplated that a different manufacturing method could be used, such as molded or cast metal. It is contemplated that the steering lock bracket 116 could have a different shape and geometry, which could be selected to suit each particular implementation of the marine outboard motor 10 and/or the steering lock lever 47 for example, to provide the functionality described in this document. It is also contemplated that the steering lock bracket 116 could be made integral with the upper motor mount 76, by being cast from metal with the upper motor mount 76 for example.

With reference to FIGS. 6 to 9, the steering lock lever 47 includes an engagement portion 120, an elongate body 122, and a mounting bracket 124 bolted to a bottom side of the body 122. The body 122 and the mounting bracket 124 define a transverse cylindrical cavity 126 therebetween. The cylindrical cavity 126 defines a lever axis 127 that the steering lock lever 47 pivots about. In the present implementation, the tilt axle 45 is received through the cavity 126 such that the steering lock lever 47 is pivotable on the tilt axle 45 between a locked position 128 (shown in FIG. 4) and an unlocked position 130 (shown in FIG. 9 and schematically shown in FIG. 4) about the tilt/trim axis 46. In other words, in the present implementation, the lever axis 127 is coaxial with the tilt/trim axis 46. It is contemplated that the lever axis 127 could be parallel to the tilt/trim axis 46 for example. In the present implementation the steering lock lever 47 is made of die cast aluminum. It is contemplated that different material(s) and/or manufacturing method(s) could be used, such as injection molded plastic.

A part 121 of the elongate body 122 of the steering lock lever 47 extends forward from the tilt/trim axis 46 and is used to manually pivot the steering lock lever 47 between the locked position 128 and the unlocked position 130. It is contemplated that an electric actuator could be used to pivot the steering lock lever 47 between the locked position 128 and the unlocked position 130. It is also contemplated that the steering lock lever 47 need not be pivotable between the locked position 128 and the unlocked position 130. In some implementations, the steering lock lever 47 could be slidable between the locked position 128 and the unlocked position 130 for example. The steering lock lever 47 is an example of a locking member that is movable relative to the steering lock bracket 116 to selectively engage the steering lock bracket 116 to prevent or limit steering of the pivot shaft 72 and the motor assembly 14, as this functionality is described in this document. It is contemplated that a locking member that is not a lever could be used instead of the steering lock lever 47.

Figure 8:
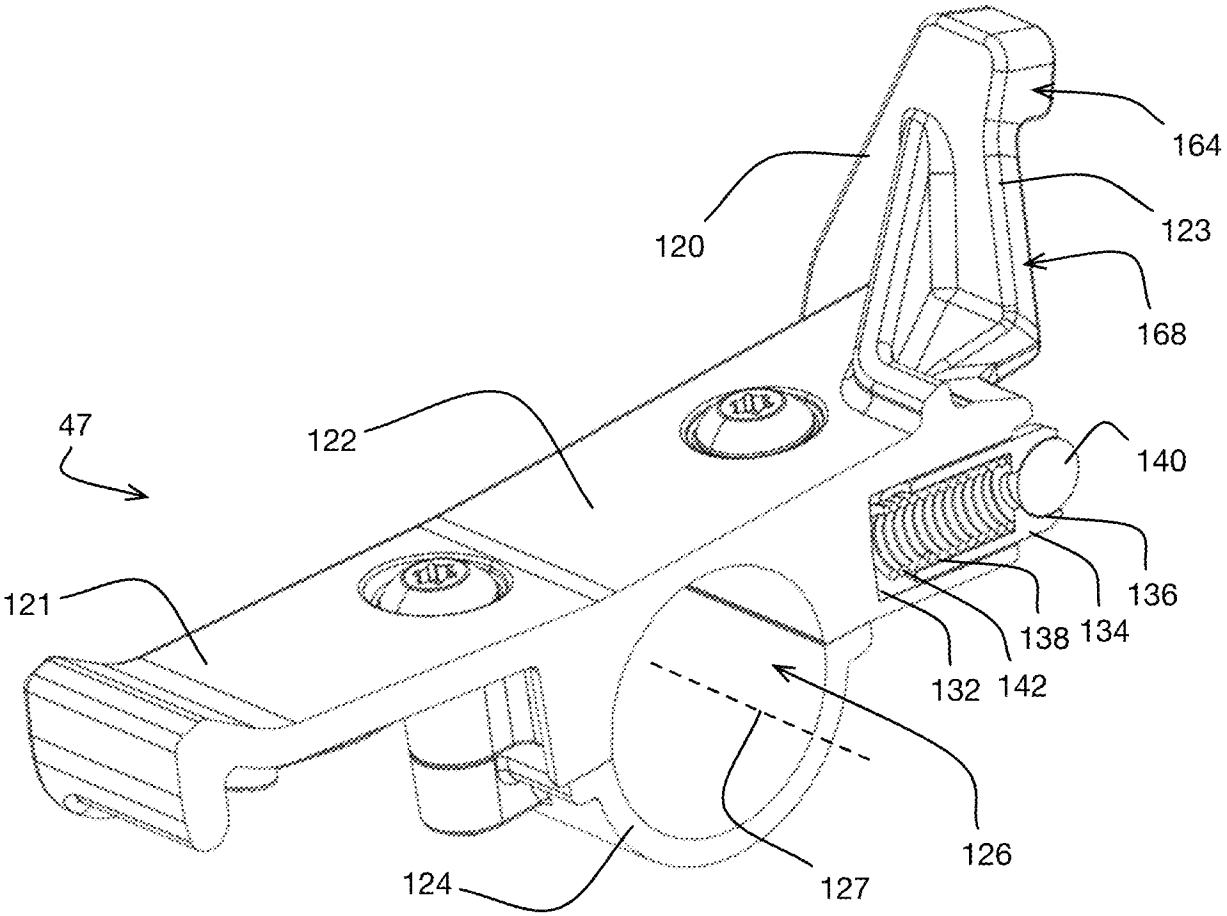
FIG. 8 is a perspective view taken from a front, right, top side of a cross-section of the steering lock lever of FIG. 6, taken along section line 8-8 of FIG. 6.

As best shown in FIG. 8, the body 122 defines a passage 132 in a rear end thereof. A contact element 140 is supported by the body 122. In the present implementation, the contact element 140 is a rolling element 140, and more particularly a stainless steel ball bearing 140. A plastic rolling element receiving body 134 is slidably received in the passage 132. The rolling element receiving body 134 defines a socket 136 on an outer side thereof, and a passage 138 on an inner side thereof. The socket 136 receives the ball bearing 140. The ball bearing 140 is rotatable in the socket 136. It is contemplated that a different contact element, such as a sliding element or a cylindrical roller could be used instead with an appropriate structure replacing the socket 136. It is also contemplated that the socket 136 could have a different shape, selected based on each particular implementation of the rolling element 140 for example.

Figure 9:
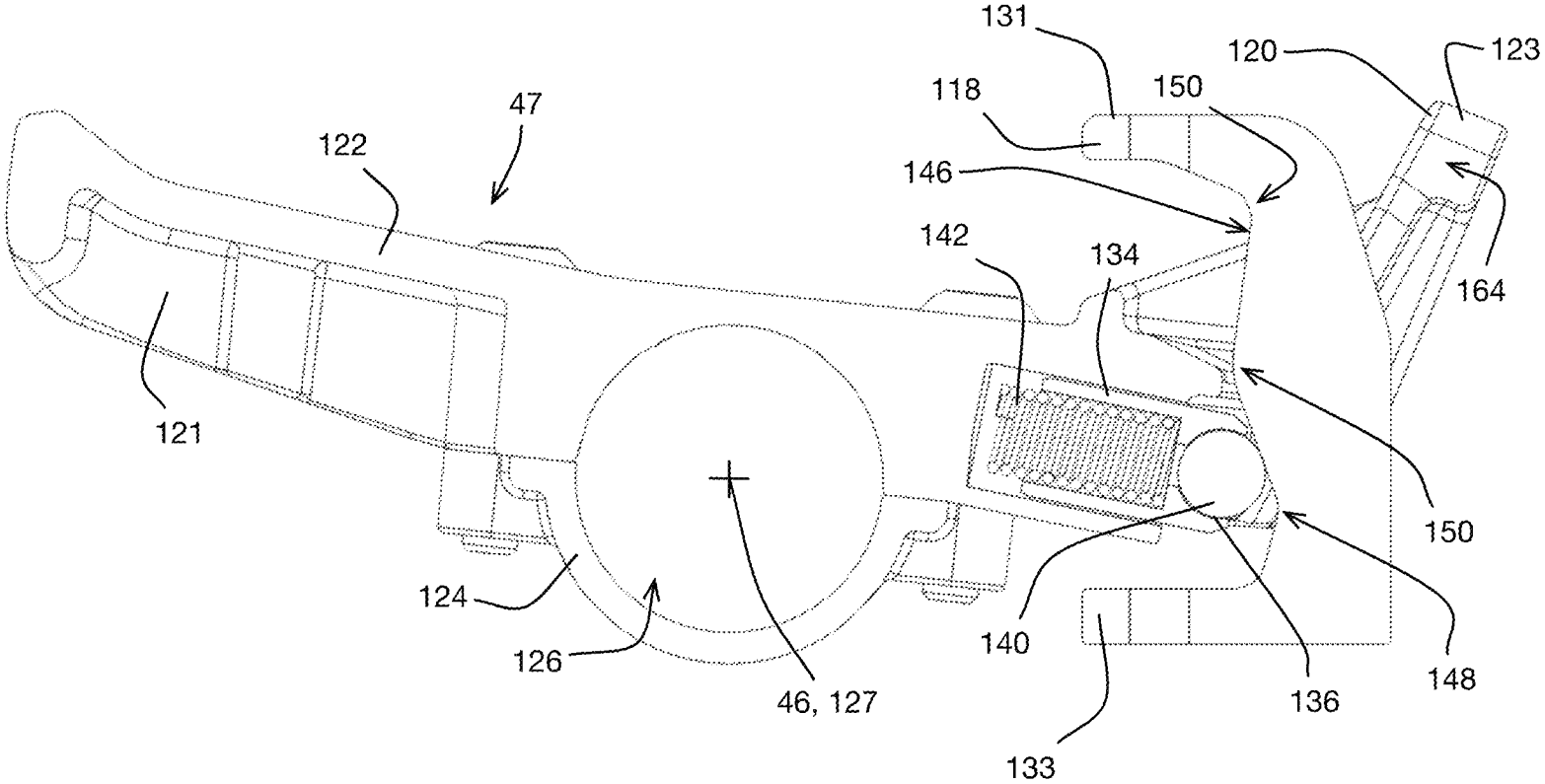
FIG. 9 is a right side elevation view of a cross-section of the steering lock lever of FIG. 6 and of a lever guide of the steering lock system of FIG. 2, taken along a line corresponding to section line 8-8 of FIG. 6, with the steering lock lever in an unlocked position.
Figure 10:
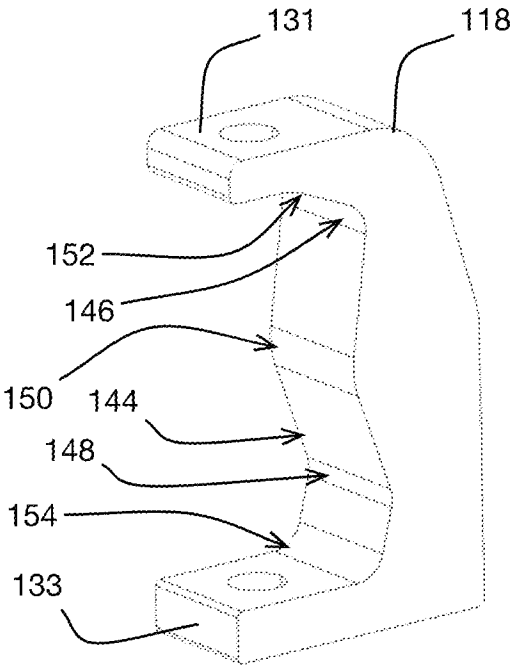
FIG. 10 is a perspective view taken from a front, right, top side of the lever guide of FIG. 9.
Figure 11:
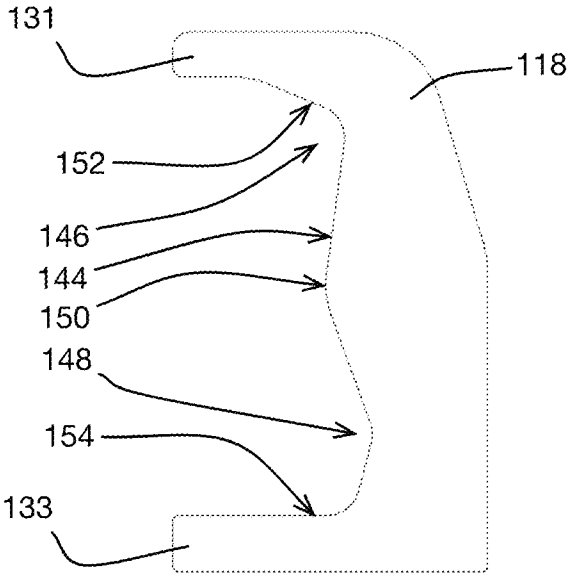
FIG. 11 is a left side elevation view of the lever guide of FIG. 9.

A spring 142 is disposed in the passage 138 between a front end of the passage 138 and the rolling element receiving body 134. As shown in FIGS. 4 and 9 for example, the spring 142 biases the ball 140 against the lever guide 118 such that the ball 140 rolls on the lever guide 118 when the steering lock lever 47 pivots between the locked position 128 and the unlocked position 130. The spring 142 is an example of a biasing member 142. It is contemplated that a different biasing member could be used.

The lever guide 118 is best shown in FIGS. 4 and 9 to 11. As shown in FIG. 4, the lever guide 118 is bolted to a portion of the swivel bracket 44 at a location in front of the steering axis 16, between the arms 41, 43 of the swivel bracket 44. In this implementation, the lever guide 118 is positioned longitudinally between the steering axis 16 and the tilt/trim axis 46. It is contemplated that the lever guide 118 could be positioned differently, depending on the position of the steering lock lever 47. In the present implementation, the lever guide 118 is extruded aluminum. It is contemplated that different material(s) and/or manufacturing method(s) could be used, such as injection molded plastic. It is also contemplated that the lever guide 118 could be integral with the swivel bracket 44.

In the present implementation, the lever guide 118 is generally C-shaped and has an upper arm 131 and a lower arm 133 and defines a lever guide surface 144 therebetween that is oriented toward the lever axis 127. The lever guide surface 144 defines an upper recess 146, a lower recess 148, and a crest 150. The crest 150 is positioned between the upper recess 146 and the lower recess 148. As shown in FIG. 9 for example, the crest 150 extends toward the lever axis 127. The upper recess 146 defines the locked position 128 of the steering lock lever 47. The lower recess 148 defines the unlocked position 130 of the steering lock lever 47.

More particularly, and as shown in FIG. 4 for example, when the steering lock lever 47 is in the locked position 128, the ball 140 is received in the upper recess 146. In this position, the spring 142 pushes the ball 140 into the upper recess 146 and thereby helps retain the ball 140 in the upper recess 146. This helps maintain the steering lock lever 47 in the locked position 128. Additionally, an upper limiting surface 152 (FIG. 10) of the lever guide surface 144 prevents the ball 140 from rolling upward beyond the upper recess 146. This helps prevent the steering lock lever 47 from pivoting upward beyond the locked position 128.

When the steering lock lever 47 is in the unlocked position 130, the ball 140 is received in the lower recess 148 in the same way as the ball 140 is received in the upper recess 146 in the locked position 128. In the unlocked position 130, the spring 142 pushes the ball 140 into the lower recess 148 and thereby helps retain the ball 140 in the lower recess 148. This helps maintain the steering lock lever 47 in the unlocked position 130. Additionally, a lower limiting surface 154 (FIG. 10) of the lever guide surface 144 prevents the ball 140 from rolling downward beyond the lower recess 148. This helps prevent the steering lock lever 47 from pivoting downward beyond the unlocked position 130. The lever guide surface 144 thereby defines limits of pivoting of the steering lock lever 47 about the lever axis 127.

As shown in FIG. 9 for example, the spring 142 pushes the ball 140 against the lever guide surface 144 while the steering lock lever 47 pivots between the locked position 128 and the unlocked position 130. When the steering lock lever 47 is between the unlocked position 130 and the crest 150 as shown in FIG. 9 for example, an inclined surface of the crest 150 on a lower side of the crest 150 directs a part of the force of the spring 142 toward the lower recess 148 and pushes the steering lock lever 47 toward the unlocked position 130. Similarly, when the steering lock lever 47 is between the locked position 128 and the crest 150, an inclined surface of the crest 150 on an upper side of the crest 150 directs a part of the force of the spring 142 toward the upper recess 146 and pushes the steering lock lever 47 toward the locked position 128. In other words, the combination of the crest 150 with the ball 140 and the spring 142 bias the steering lock lever 47 toward the locked position 128 when the steering lock lever 47 is pivoted past the crest 150 toward the locked position 128, and toward the unlocked position 130 when the steering lock lever 47 is pivoted past the crest 150 toward the unlocked position 130. Additionally, the crest 150 and the spring 142 cooperate to such that a some force needs to be applied to the steering lock lever 47 to overcome the biasing force of the spring 142 to move the steering lock lever 47 out of the locked position 128 and the unlocked position 130, as well as to roll the ball 140 over the apex of the crest 150 in either direction.

Figure 6:
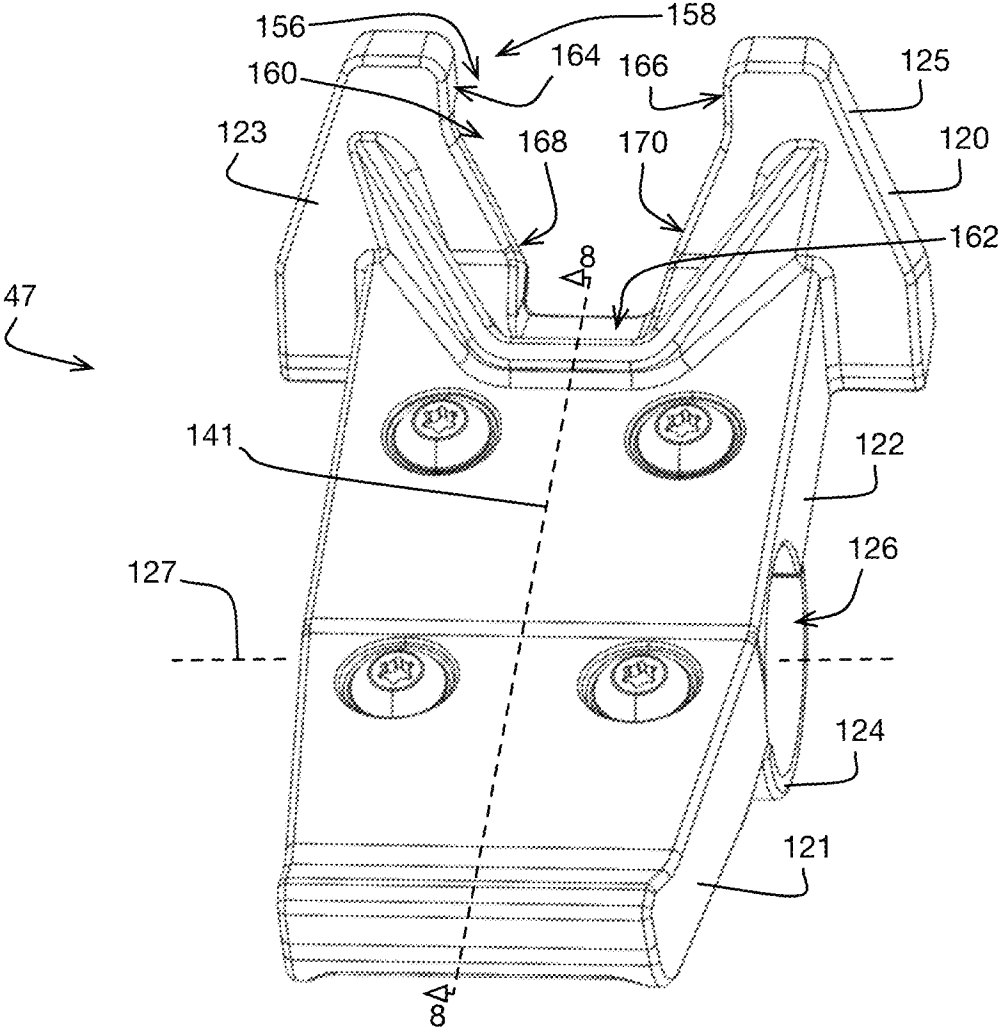
FIG. 6 is a perspective view taken from a front, right, top side of a steering lock lever of the steering lock system of the bracket assembly of FIG. 2.
Figure 7:
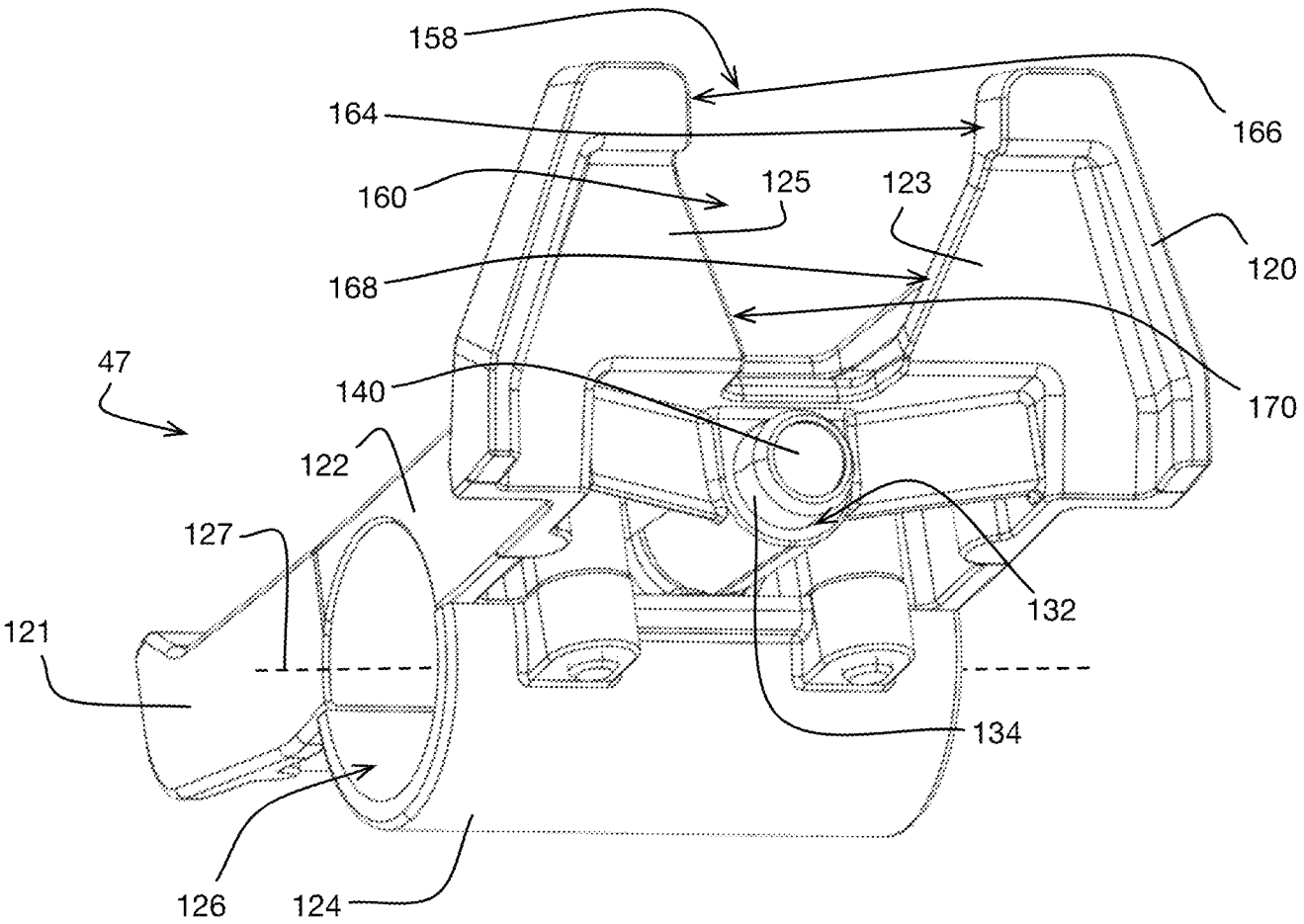
FIG. 7 is a perspective view taken from a rear, bottom, left side of the steering lock lever of FIG. 6.

In another aspect, and as best shown in FIG. 4 for example, when the steering lock lever 47 is in the locked position 128, the engagement portion 120 of the steering lock lever 47 engages the steering lock bracket 116 and thereby prevents pivoting of the pivot shaft 72, and therefore the motor assembly 14, in either direction about the steering axis 16. To this end, as shown in FIGS. 6 and 7, the engagement portion 120 has two prongs 123, 125 that define a cavity 156 therebetween. In the present implementation, the prongs 123, 125 are positioned symmetrically relative to a longitudinal centerline 141 (FIG. 6) of the steering lock lever 47. It is contemplated that this need not be the case in at least some implementations.

In this implementation, the cavity 156 includes a upper portion 158 and a lower portion 160 below the upper portion 158. In the present implementation, the elongate portion 117 of the steering lock bracket 116 is received in the upper portion 158 when the steering lock 47 is in the locked positioned 128. The upper portion 158 of the cavity 156 is defined by opposed surfaces 164, 166. In the present implementation, the opposed surfaces 164, 166 are generally parallel to each other. The distance between the opposed surfaces 164, 166 is slightly larger than the width of the corresponding portion of the elongate portion 117 enabling the latter to be received easily between the former. It is contemplated that in some implementations, the opposed surfaces 164, 166 could slope toward each other in a direction from a top part of the upper portion 158 toward a bottom part of the upper portion 158 and thereby narrow the upper portion 158 from its top part toward its bottom part.

As shown in FIG. 6, the lower portion 160 is defined by a bottom surface 162 and opposed surfaces 168 and 170. In the present implementation, the upper arm 131 of the lever guide 118 is received in the lower portion 160 when the steering lock lever 47 is in the locked position 128. In this position, the upper arm 131 contacts a bottom surface 162 of the lower portion 160 and thereby helps limit upward pivoting movement of the steering lock lever 47 about the lever axis 127. It is contemplated that in some implementations, the upper arm 131 could not contact the bottom surface 162 when the steering lock lever 47 is in the locked position 128. In some such implementations, the upper recess 146 could be the only element limiting upward pivoting movement of the steering lock lever 47.

The upper portion 158 of the cavity 156 is sized and shaped such that when the motor assembly 14 is steered straight ahead about the steering axis 16, the steering lock bracket 116 aligns with the upper portion 158. In this position, the steering lock lever 47 can be pivoted about the lever axis 127 from the unlocked position 130 to the locked position 128 such that the upper portion 158 of the cavity 156 will receive the elongate portion 117 of the steering lock bracket 116 therein, as shown in FIGS. 2 and 3 for example. The clearance between the opposed surfaces 164, 166 of the steering lock lever 47 and the lateral sides of the elongate portion 117 of the steering lock bracket 116 permit a slight lateral movement of the steering lock bracket 116 about the steering axis 16, for example 1 degree of rotation about the steering axis 16, before contact between one of the opposed surfaces 164, 166 and the elongate portion 117 will prevent any further movement and therefore also prevents pivoting of the pivot shaft 72, and the motor assembly 14, in either direction about the steering axis 16. It is contemplated that in some implementations, the cavity 156 need not have the lower portion 160.

It is contemplated that the upper portion 158 of the engagement portion 120 of the steering lock lever 47 could be sized to frictionally engage the elongate portion 117 of the steering lock bracket 116 when the steering lock lever 47 is in the locked position, providing no clearance between the opposed surfaces 164, 166 and the lateral sides of the elongate portion 117.

The steering lock lever 47, the steering lock bracket 116 and the lever guide 118 are an example of one implementation of the steering lock system 115 of the marine outboard motor 10. It is contemplated that the steering lock functionality provided by the steering lock system 115 could be provided by different implementations and/or arrangements of the lever guide 118 and/or the steering lock lever 47 and/or the steering lock bracket 116.

Figure 12:
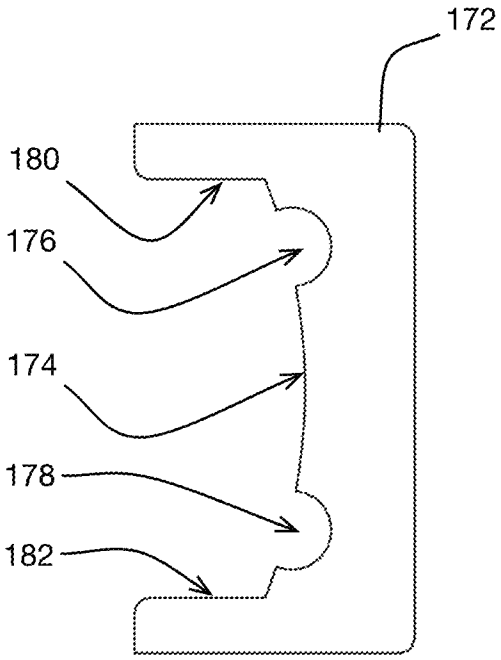
FIG. 12 is a left side elevation view of an alternative implementation of the lever guide of FIG. 9.

For example, FIG. 12 shows a lever guide 172, which is a different implementation of the lever guide 118. A lever guide surface 174 of the lever guide 172 has a concave shape that faces the lever axis 127. An upper recess 176 and a lower recess 178 are defined in the concave shape. In this implementation, the ball 140 rolls on the concave lever guide surface 174 as the steering lock lever 47 pivots to the locked position 128 and until it is received into the upper recess 176 when the locked position 128 is reached. An operator must then apply more force to the steering lock lever 47 than was required to pivot the steering lock lever 47 to the locked position 128 in order to remove the steering lock lever 47 from the locked position 128.

Similarly, in this implementation, the ball 140 rolls on the concave lever guide surface 174 as the steering lock lever 47 pivots to the unlocked position 130 and is received into the lower recess 178 when the unlocked position 130 is reached. An operator must then apply more force to the steering lock lever 47 than was required to pivot the steering lock lever 47 to the unlocked position 130 in order to remove the steering lock lever 47 from the unlocked position 130.

Also, similar to the lever guide 118, the lever guide 172 shown in FIG. 12 has an upper limiting surface 180 and a lower limiting surface 182 that define limits of pivoting of the steering lock lever 47 about the tilt/trim axis 46. The limiting surfaces 180, 182 help prevent the steering lock lever 47 from being pivoted past the locked position 128 in a direction away from the unlocked position 130, and past the unlocked position 130 in a direction away from the locked position 128.

Figure 13:
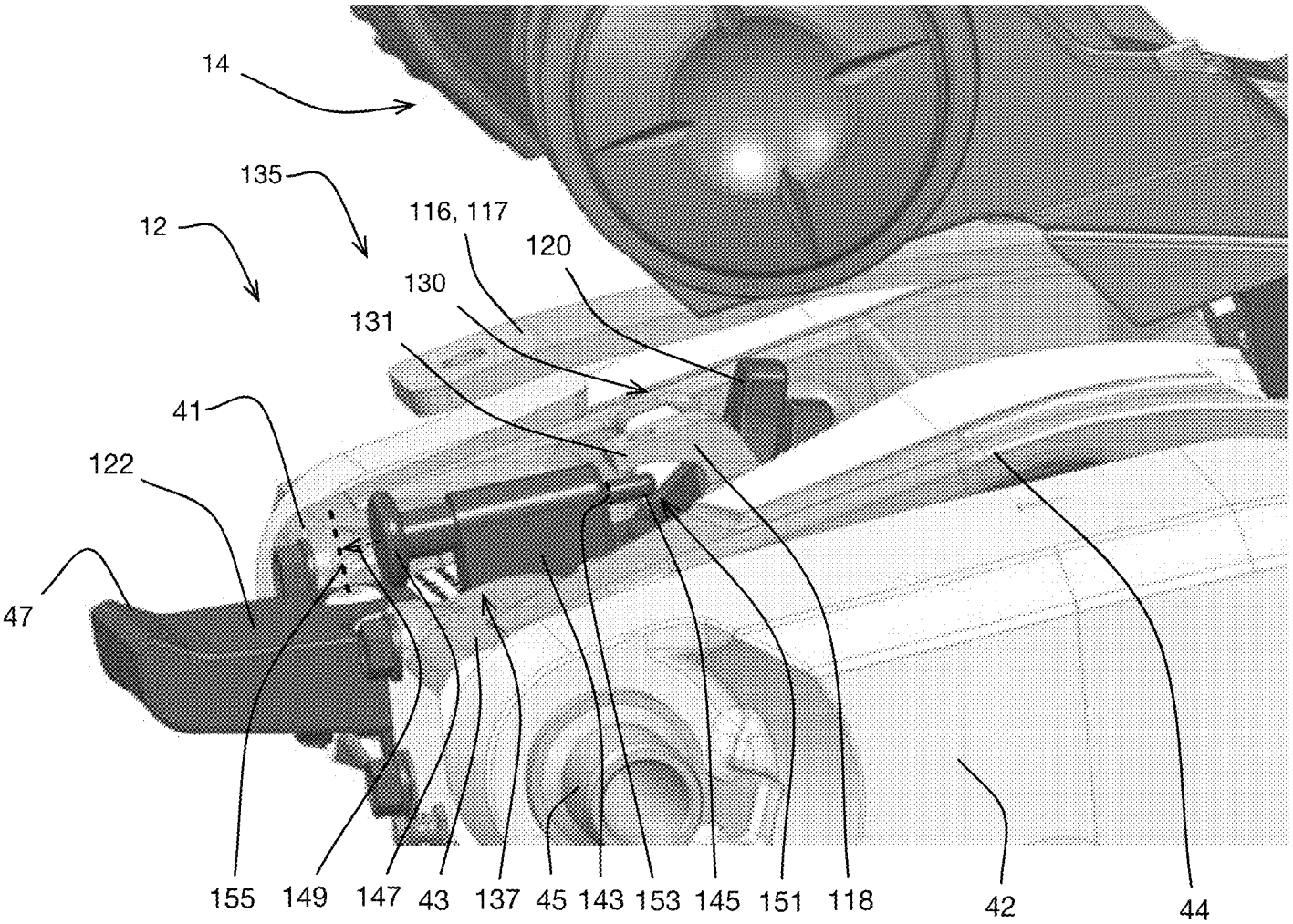
FIG. 13 is a close-up perspective view taken from a front, left, top side of the marine outboard motor of FIG. 1, showing an alternative implementation of the steering lock system of the marine outboard motor.

As another example, FIG. 13 shows a steering lock system 135, which is a different implementation of the steering lock system 115. The steering lock system 135 has similar elements to those of the steering lock system 115. Elements of the steering lock system 135 that are similar to those of the steering lock system 115 have been labeled with the same reference numerals and will not be described herein in more detail. One difference between the steering lock system 115 and the steering lock system 135 is that the latter includes a latch 137. The latch 137 includes a body 143 attached to the elongate body 122 of the steering lock lever 47, an engagement member 145 defining a handle 147 at a front thereof and extending through the body 123 and a spring (not shown) biasing the engagement member 145 into a locked position 151 (shown in FIG. 13). The engagement member 145 can be manually pulled by an operator as shown with reference arrow 149, from the locked position 151 to an unlocked position 153, shown schematically in FIG. 13. The position of the handle 147 of the latch 137 that corresponds to the unlocked position 153 of the engagement member 145 is shown with reference line 155.

In the locked position 151, the engagement member 145 engages the upper arm 131 of the lever guide 118 when an operator attempts to pivot the steering lock lever 47 from its unlocked position 130 toward its locked position 128 and prevents the steering lock lever 47 from pivoting to its locked position 128. Accordingly, in this implementation of the steering lock system 135, when the steering lock lever 47 is in its unlocked position 130 and the engagement member 145 of the latch 137 is in its locked position 151, an operator needs to pull the handle 147 forward and move the engagement member 145 to its unlocked position 153 before the operator can pivot the steering lock lever 47 to its locked position 128. When releasing the handle 147, the spring of the latch 137 returns the engagement member 145 to its locked position 151. The latch 137 similarly needs to be moved to its unlocked position 153 to move the steering lock lever 47 back to its unlocked position 130. It is contemplated that a different type of latch 137, or other limiting mechanism, could be used instead of or in addition to the latch 137 in order to provide the functionality of the latch 137 as described herein above.

Figure 14:
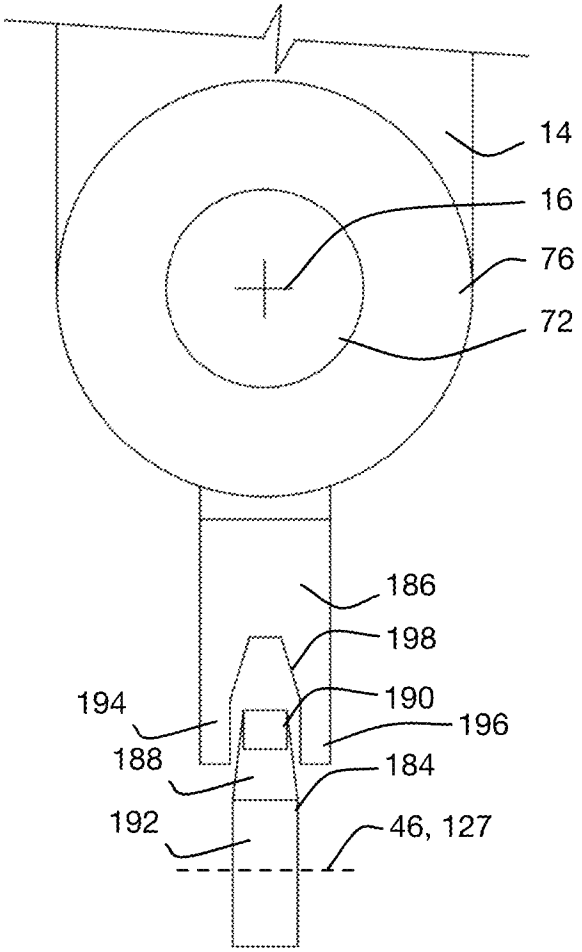
FIG. 14 is a schematic top plan view of the pivot shaft, the upper motor mount, and alternative implementations of the steering lock bracket, and the steering lock lever of the marine outboard motor of FIG. 1.

As another example, FIG. 14 schematically shows a steering lock lever 184 and a steering lock bracket 186, which are different implementations of the steering lock lever 47 and the steering lock bracket 116, respectively. Similar to the steering lock lever 47, the steering lock lever 184 is mounted on the tilt axle 45 to pivot about the tilt/trim axis 46 between the locked position 128 and the unlocked position 130. However, unlike the engagement portion 120 of the steering lock lever 47, the engagement portion 188 of the steering lock lever 184 defines a single prong 190 that extends generally upward relative to the elongate body 192 of the steering lock lever 184. In this implementation the prong 190 is rectangular, but other shapes are contemplated. The prong 190 engages the steering lock bracket 186 when the steering lock lever 184 is in the locked position 128 and thereby limits pivoting of the upper motor mount 76, and the pivot shaft 72, about the steering axis 16.

More particularly, the steering lock bracket 186 has two prongs 194, 196 that define a cavity 198 therebetween. As shown in FIG. 14, the cavity 198 is open at a front side of the steering lock bracket 186. The cavity 198 receives the prong 190 of the steering lock lever 184 therein when the steering lock lever 184 is in the locked position 128. As shown, the cavity 198 is sized to be slightly wider than the prong 190 of the steering lock lever 184 such that engagement between the prongs 194, 196 and the prong 190 limits pivoting of the upper motor mount 76, and the motor assembly 14, about the steering axis 16. In this implementation, cooperation between the prong 190 of the steering lock lever 184 and the prongs 194, 196 of the steering lock bracket 186 limits pivoting of the upper motor mount 76 to being within about two degrees in either direction from the straight-forward steering position thereof. It is contemplated that the cavity 198 and/or the prong 190 could be sized differently, to provide a different pivot limiting range, including a range that effectively prevents any pivoting of the upper motor mount 76 and the motor assembly 14 about the steering axis 16.

Figure 15:
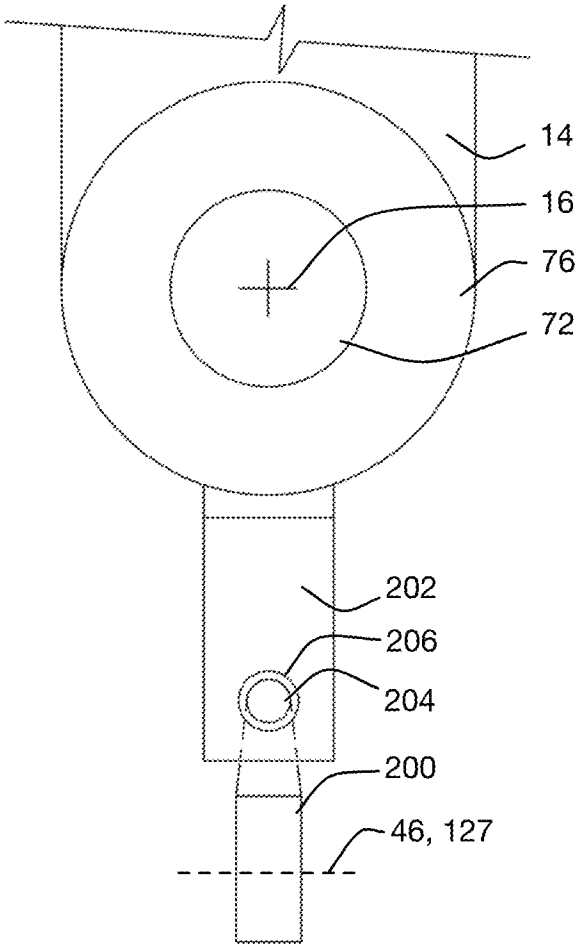
FIG. 15 is a schematic top plan view of the pivot shaft, the upper motor mount, and other alternative implementations of the steering lock bracket, and the steering lock lever of the marine outboard motor of FIG. 1.

As another example, FIG. 15 shows a steering lock lever 200 and a steering lock bracket 202, which are different implementations of the steering lock lever 184 and the steering lock bracket 186, respectively. The steering lock lever 200 has an upwardly extending prong 204 that is generally cylindrical. The steering lock bracket 202 has a cavity 206 defined therein. In this implementation, the cavity 206 is a circular aperture 206 that is closed on all sides. The prong 204 is oriented relative to the rest of the steering lock lever 200 such that it is received in the aperture 206 when the steering lock lever 200 is in the locked position 128.

As shown, the aperture 206 is sized slightly larger than the prong 204 and allows for some pivoting of the upper motor mount 76, and the pivot shaft 72, about the steering axis 16 when the steering lock lever 200 is in the locked position 128. That is, when the prong 204 is received in the aperture 206, the steering lock bracket 202, the pivot shaft 72, and the motor assembly 14 can pivot about the steering axis 16 in either direction until a side surface of the prong 204 contacts a surface of the steering lock bracket 202 that defines the aperture 206. In this implementation, this pivoting does not exceed one degree about the steering axis 16, but other ranges are also contemplated, depending on each particular implementation and application of the marine outboard motor 10 for example.

Figure 16:
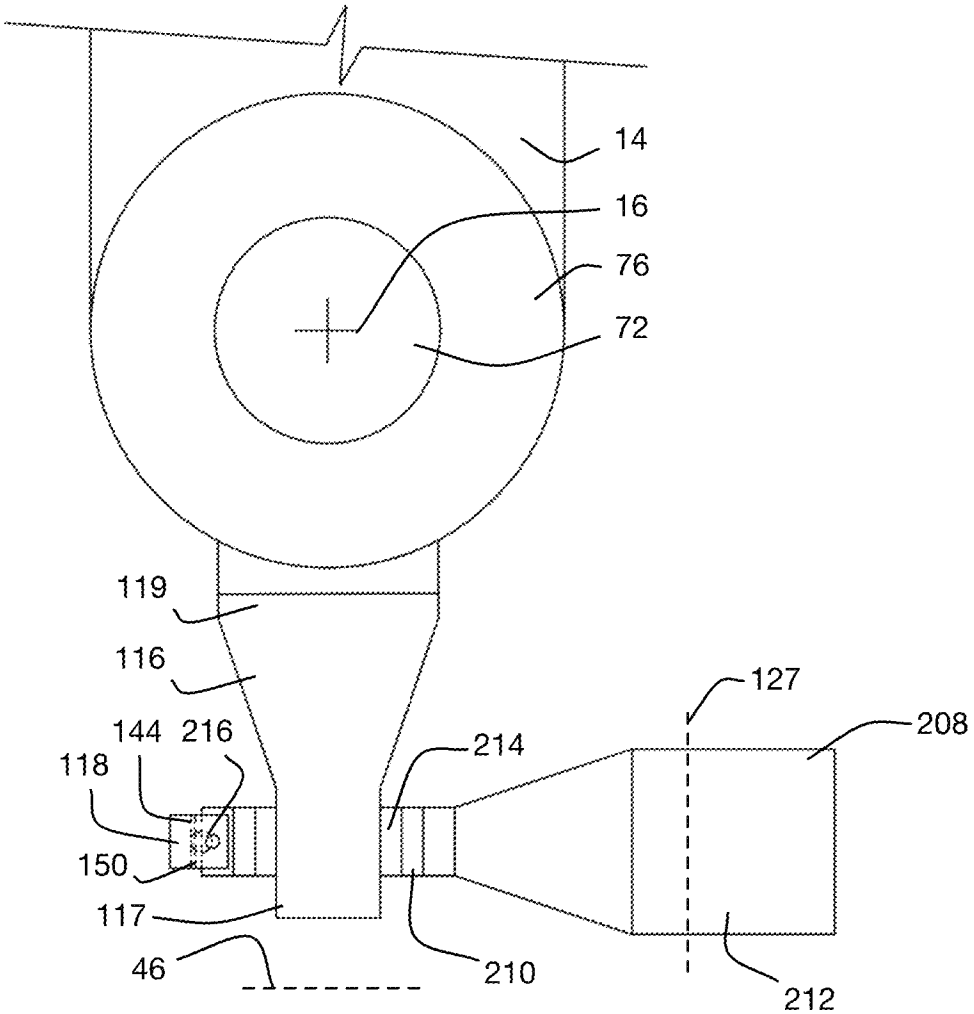
FIG. 16 is a schematic top plan view of the pivot shaft, the upper motor mount, and other alternative implementations of the steering lock bracket, the steering lock lever, and the lever guide of the marine outboard motor of FIG. 1, according to yet another implementation.

FIG. 16 schematically shows yet another implementation of the steering lock system 115. More particularly, FIG. 16 schematically shows a steering lock lever 208, the steering lock bracket 116, and the lever guide 118. The steering lock lever 208 is a different implementation of the steering lock lever 184. The steering lock lever 208 is pivotably mounted to the swivel bracket 44 such that the lever axis 127 is generally orthogonal to the tilt/trim axis 46. In this implementation, the steering lock lever 208 has similar elements to those of the steering lock lever 47. One difference is that the engagement portion 210 of the steering lock lever 208 has the shape of the engagement portion 120 (see FIG. 7 for example) but is oriented generally parallel to the elongate body 212 of the steering lock lever 208. Another difference is that, as schematically illustrated in FIG. 16, the ball 216 of the steering lock lever 208 extends generally rightward from what is in this implementation a right end of the steering lock lever 208.

In turn, the lever guide 118 in this implementation is mounted at a different location on the swivel bracket 44 than in the implementation of FIGS. 1 to 11. The different location corresponds to the position of the steering lock lever 208. More particularly, in this implementation, the lever guide 118 is positioned such that the lever guide surface 144 of the lever guide 118 faces the lever axis 127 and the ball 216 rolls on and cooperates with the lever guide surface 144 in the same way as the ball 140 rolls and cooperates with the lever guide surface 144 in the implementation of FIGS. 1 to 11 described herein above.

That is, the ball 216 is received in the upper recess 146 (FIGS. 9 and 10) when the steering lock lever 208 is pivoted to the locked position 128 and in the lower recess 148 (FIGS. 9 and 10) when the steering lock lever 208 is pivoted to the unlocked position 130. To pivot the steering lock lever 208 from the locked position 128 to the unlocked position 130, or vice versa, sufficient force must be applied thereto to roll the ball 216 over the apex of the crest 150. When the steering lock lever 208 is in the locked position 128 the right end thereof contacts the upper arm 131 of the lever guide 118. When the steering lock lever 208 is in the unlocked position 130 the right end thereof contacts the lower arm 133 of the lever guide 118. The lever guide 118 thereby defines limits of pivoting of the steering lock lever 208 about the lever axis 127. It is contemplated that the lever guide 172 could be used instead of the lever guide 118 for example.

In the implementation of FIG. 16, the cavity 214 defined by the engagement portion 210 of the steering lock lever 208 is slightly wider than the elongate portion 117 of the steering lock bracket 116 and limits pivoting of the steering lock bracket 116 and the motor assembly 14 about the steering axis 16 when the steering lock lever 208 is in the locked position 128, similar to the implementations of FIGS. 14 and 15.

Figure 17:
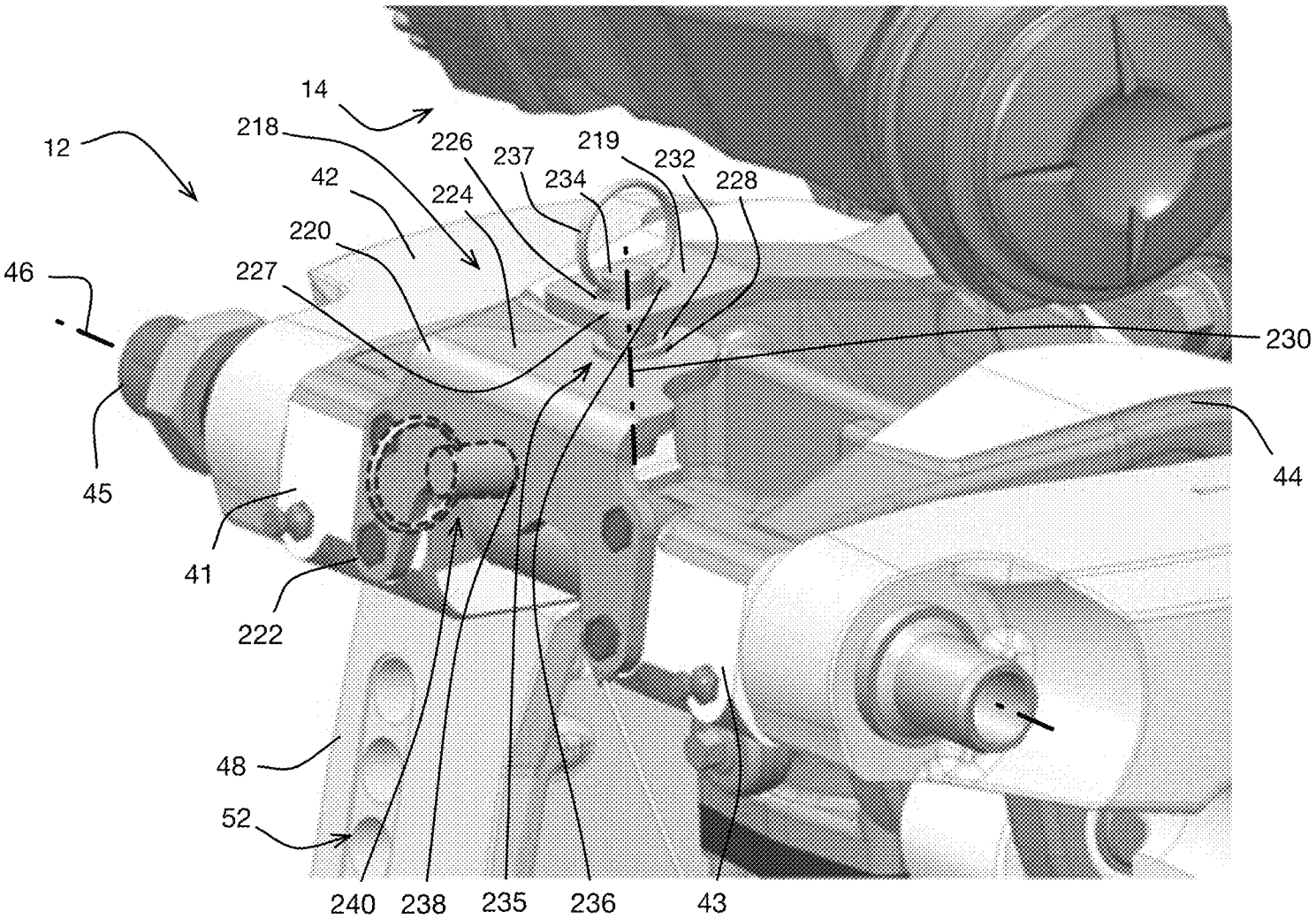
FIG. 17 is a close-up perspective view taken from a front, left, top side of the marine outboard motor of FIG. 1, showing an alternative implementation of the steering lock system of the marine outboard motor.

Now referring to FIG. 17, the bracket assembly 12 that includes a steering lock system 218 will be described. The steering lock system 218 is yet another implementation of the steering lock system 115. The steering lock system 218 includes a steering lock bracket 219 that is similar to the steering lock bracket 116 of the steering lock system 115. The steering lock system 218 further includes a second steering lock bracket 220. In this implementation, the second steering lock bracket 220 is L-shaped. The second steering lock bracket 220 has an attachment portion 222 that is bolted to a front side of the swivel bracket 44 intermediate the arms 41, 43 of the swivel bracket 44. The second steering lock bracket 220 includes a receiving portion 224 that extends rearward from a top portion of the attachment portion 222.

In the present implementation, the attachment portion 222 and the receiving portion 224 of the second steering lock bracket 220 are made from a single piece of metal that is stamped and formed to the shape shown in the figure. It is contemplated that a different manufacturing method could be used, such as molded or cast metal. It is contemplated that the second steering lock bracket 220 could have a different shape and geometry, which could be selected to suit each particular implementation of the marine outboard motor 10 and/or the steering lock bracket 219 for example, to provide the functionality described in this document. It is also contemplated that the second steering lock bracket 220 could be made integral with swivel bracket 44, by being cast from metal with the swivel bracket 44 for example.

In the present implementation, an aperture 226 is defined in a vertical direction 230 through a front end of the elongate portion 227 of the steering lock bracket 219, and an aperture 228 is defined in the vertical direction 230 through a rear end of the receiving portion 224 of the second steering lock bracket 220. As shown in FIG. 17, in the present implementation, the receiving portion 224 of the second steering lock bracket 220 is disposed under the front end of the elongate portion 227 of the steering lock bracket 219 when the motor assembly 14, and therefore the motor mount 76, is in the straight-forward steering position. In this position, the apertures 226, 228 align with each other. It is contemplated that the steering lock brackets 219, 220 could be sized and shaped differently, and could define the apertures 226, 228 in different respective portions thereof, to provide for the functionality described herein.

In the present implementation, a bushing 232 is press-fitted into the aperture 228 of the second steering lock bracket 220. It is contemplated that the bushing 232 could be omitted in some implementations. To lock the steering lock bracket 219 in position, a metal locking pin 234 is inserted in the aperture 226 of the steering lock bracket 219 and the aperture 228 of the second steering lock bracket 220. In this implementation, the locking pin 234 includes a metal ring 237 at a top end thereof, sized to receive an operator's finger therethrough. FIG. 17 shows the locking pin 234 in a locked position 235. The aperture 226 is sized slightly larger than the locking pin 234 to permit the locking pin 234 to be easily received therethrough and positioned in its locked position 235, manually by an operator. The clearance between the surface 236 of the steering lock bracket 219 that defines the aperture 226 and the locking pin 234 permits a slight lateral movement of the steering lock bracket 219 about the steering axis 16, for example 1 degree of rotation about the steering axis 16, before contact between the surface 236 and the locking pin 234 will prevent any further movement of the steering lock bracket 219, and therefore also the pivot shaft 72, in either direction about the steering axis 16.

It is contemplated that the aperture 226 of the steering lock bracket 219 could be sized to frictionally engage the locking pin 234 when the locking pin 234 is in its locked position 235. It is also contemplated that in some such implementations, the bushing 232 could be sized slightly larger than the locking pin 234 such that there would be a clearance between the surface of the bushing 232 facing the locking pin 234 and the locking pin 234, which clearance would permit a slight lateral movement of the steering lock bracket 219 about the steering axis 16, for example 1 degree of rotation about the steering axis 16, before contact between the bushing 232 and the locking pin 234 will prevent any further movement of the steering lock bracket 219, and therefore also the pivot shaft 72, in either direction about the steering axis 16.

In the present implementation, removal of the locking pin 234 from the apertures 226, 228, or at least from the aperture 228, for example manually by an operator, disengages the steering lock bracket 219 from the steering lock bracket 220 and thereby permits the steering lock bracket 219, and therefore also the motor assembly 14 and the motor mount 76, to pivot in either direction about the steering axis 16. In the present implementation, the attachment portion 222 of the second steering lock bracket 220 includes another aperture 238 defined therein. As shown schematically in FIG. 17, the aperture 238 is sized to frictionally receive the locking pin 234 therein after the locking pin 234 has been removed from the apertures 226, 228, for storing the locking pin 234. FIG. 17 schematically shows the locking pin 234 in a stored position 240 in dotted lines. In the stored position 240, the locking pin 234 is removably received in the aperture 238.

It is contemplated that the aperture 238 could be defined elsewhere in the steering lock bracket 220 and/or other part(s) of the marine outboard motor 10. It is also contemplated that the aperture 238 could be omitted. The locking pin 234 is one example of a locking member that could be used to provide the functionality described herein above. It is contemplated that a different locking member could be used instead of or in addition to the locking pin 234.

Figure 18:
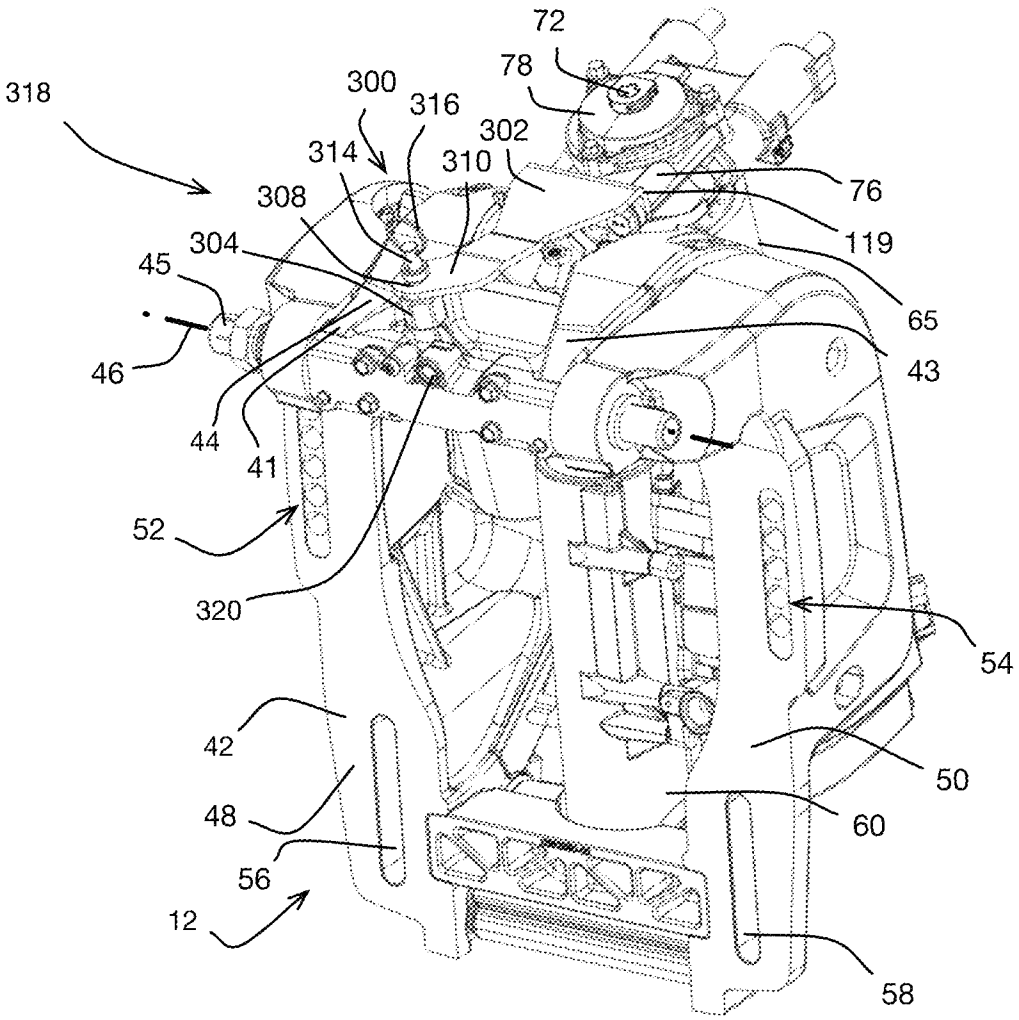
FIG. 18 is a perspective view taken from a front, left, top side of a bracket assembly of the marine outboard motor of FIG. 1, showing an alternative implementation of the steering lock system of the marine outboard motor.

Now referring to FIGS. 18 and 19, the bracket assembly 12 that includes a steering lock system 300 will be described. The steering lock system 300 is yet another implementation of the steering lock system 115. The steering lock system 300 includes a steering lock bracket 302 that is similar to the steering lock bracket 116 of the steering lock system 115. The swivel bracket 44 includes an upstanding pin-receiving member 304. In this implementation, the pin-receiving member 304 is threaded into a corresponding threaded cylindrical recess 306 defined in another part of the swivel bracket 44, as shown in FIG. 19.

Figure 19:
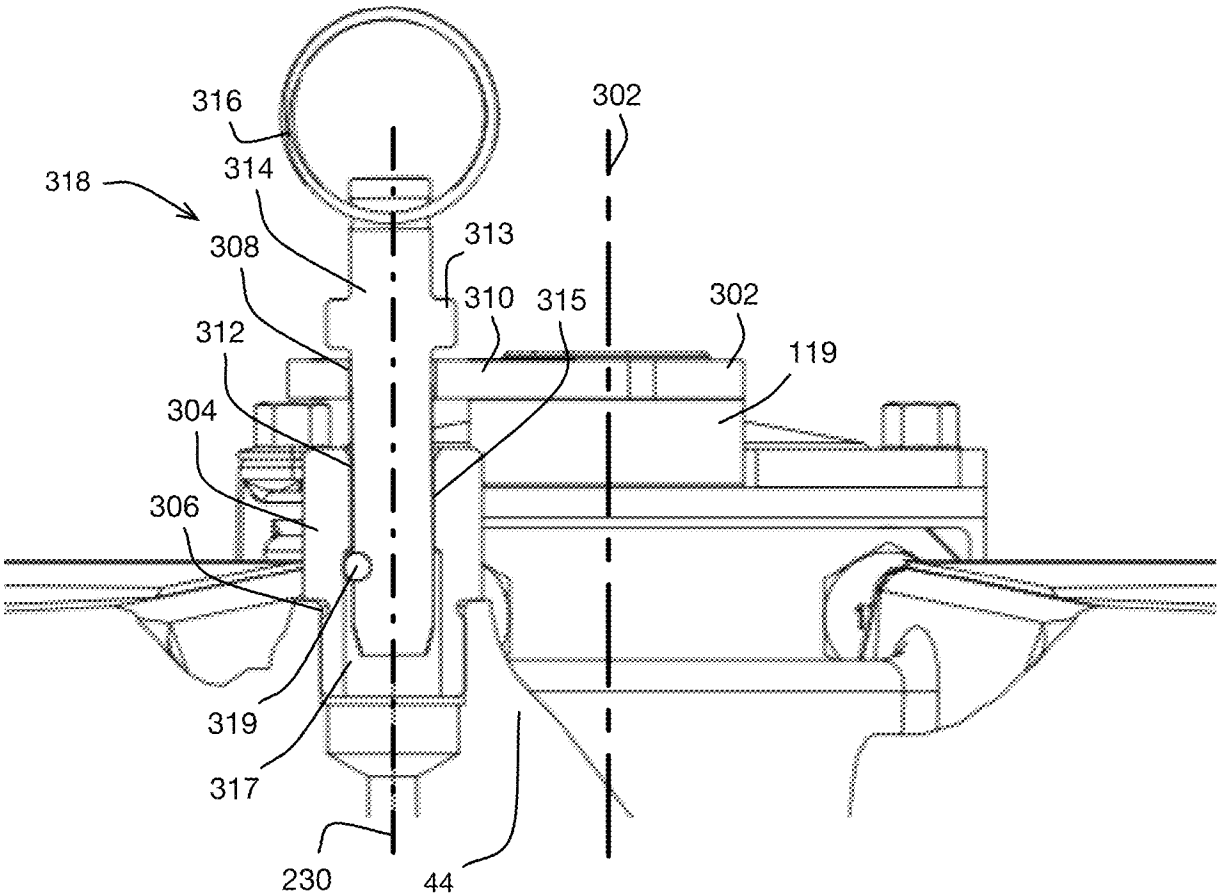
FIG. 19 is a close-up partial cross-section view of the steering lock system of FIG. 18, taken along a transverse vertical plane passing through a locking member of the steering lock system.

As shown in FIG. 19, in the present implementation, the pin-receiving member 304 and the recess 306 are positioned on a right side of a vertical longitudinal center plane 307 of the bracket assembly 12. As shown in FIGS. 18 and 19, the steering lock bracket 302 is shaped to extend rightward from the vertical longitudinal center plane 307 and over the pin-receiving member 304 when the upper motor mount 76 is in a straight-ahead steering position. In the present implementation, the vertical longitudinal center plane 307 of the bracket assembly 12 is also the vertical longitudinal center plane 307 of the marine outboard motor 10 when the marine outboard motor is in a straight-ahead steering position. It is contemplated that a different position of the pin-receiving member 304 and the recess 306, with a corresponding different shape of the steering lock bracket 302, could be used. For example, it is contemplated that the pin-receiving member 304 and the recess 306 could be positioned on a left side of the vertical longitudinal center plane 307, with the steering lock bracket 302 extending leftward from the vertical longitudinal center plane 307 and over the pin-receiving member 304 when the upper motor mount 76 is in a straight-ahead steering position. It is also contemplated that the pin-receiving member 304 could be made integral with the rest of the swivel bracket 44, by being cast from metal with the swivel bracket 44 for example.

Referring to FIG. 19, in the present implementation, an longitudinally elongate aperture 308 is defined in the vertical direction 230 through a front end of the elongate portion 310 of the steering lock bracket 302, and an aperture 312 is defined in the vertical direction 230 in a top surface of the pin-receiving member 304. Since in this implementation the pin-receiving member 304 is part of the swivel bracket 44, it can be said that the swivel bracket 44 has the aperture 312. As shown in FIG. 19, in the present implementation, the pin-receiving member 304 is disposed under the front end of the elongate portion 310 of the steering lock bracket 302 when the motor assembly 14, and therefore the motor mount 76, is in the straight-forward steering position. In this position, the apertures 308, 312 align with each other along the vertical direction 230.

To lock the steering lock bracket 302 in position, a metal locking pin 314 is inserted in the aperture 308 of the steering lock bracket 302 and the aperture 312 in the pin-receiving member 304. FIG. 19 shows the locking pin 314 in a locked position 318. The aperture 308 is longitudinally elongate to allow for a small margin of imperfect alignment between the apertures 308, 312 within which the locking pin 314 can nonetheless be manually inserted both through the aperture 308 and into the aperture 312.

The locking pin 314 includes a flange 313 that extends radially outward and which rests against the upper surface of the steering lock bracket 302 surrounding the aperture 308. In the present implementation, the locking pin 314 includes a metal ring 316 at a top end thereof, sized to receive an operator's finger therethrough and a tether (not shown) fixed to the bracket assembly 12. As shown, the aperture 312 in the pin-receiving member 304 has an upper portion 315 and a lower portion 317. The upper portion 315 is smaller in diameter than the lower portion 317, and is disposed above the lower portion 317.

The locking pin 314 includes a metal ball 319 that is received in a corresponding recess (not separately labeled) defined in the locking pin 314 and is biased radially away from a central axis of the locking pin 314. As the locking pin 314 is inserted into the upper portion 315 of the aperture 312, the ball 319 is pushed radially inward into the recess in the locking pin 314 and thereby allows the locking pin 314 to be pushed into the lower portion 317 of the aperture 312.

When the ball 319 reaches the lower portion 317, the ball 319 moves outward as shown in FIG. 19, and thereby removably locks the locking pin 314 in the pin-receiving member 304. This helps avoid the locking pin 314 inadvertently being removed from the pin-receiving member 304 and/or being lost. The ball 319 is an example of an auxiliary locking member that removably engages the pin-receiving member 304 when received in the aperture 312 of the pin-receiving member 304. It is contemplated that a different auxiliary locking member and/or auxiliary locking mechanism could be used. It is also contemplated that the ball 319 could be omitted.

It is also contemplated that the pin-receiving member 304 could be omitted, in which case the aperture 312 could for example be defined directly in the top surface of the swivel bracket 44 in the vertical direction 230, in place of the recess 306. In such embodiments, to lock the steering lock bracket 302 in position, the locking pin 314 is inserted through the aperture 308 in the steering lock bracket 302 and into the aperture 312 defined directly in the swivel bracket 44.

In the present implementation, a part of the surface of the steering lock bracket 302 defining the aperture 308 is shaped to engage the locking pin 314 when the locking pin 314 is in its locked position 318 to prevent rotation of the motor assembly 14 about the steering axis 16, while allowing the locking pin 314 to be easily manually inserted into and removed from the apertures 308 and the aperture 312. It is contemplated that a clearance between the surface of the steering lock bracket 302 that defines the aperture 308 and the locking pin 314 could be made sufficiently large to permit a small range of steering angles in which the locking pin 314 can be inserted through the aperture 308 and into the pin-receiving member 304. For example, 1 degree of rotation about the steering axis 16 could be permitted, before contact between the surface of the steering lock bracket 302 and the locking pin 314 will prevent any further movement of the steering lock bracket 302, and therefore also the pivot shaft 72, in either direction about the steering axis 16.

Figure 20:
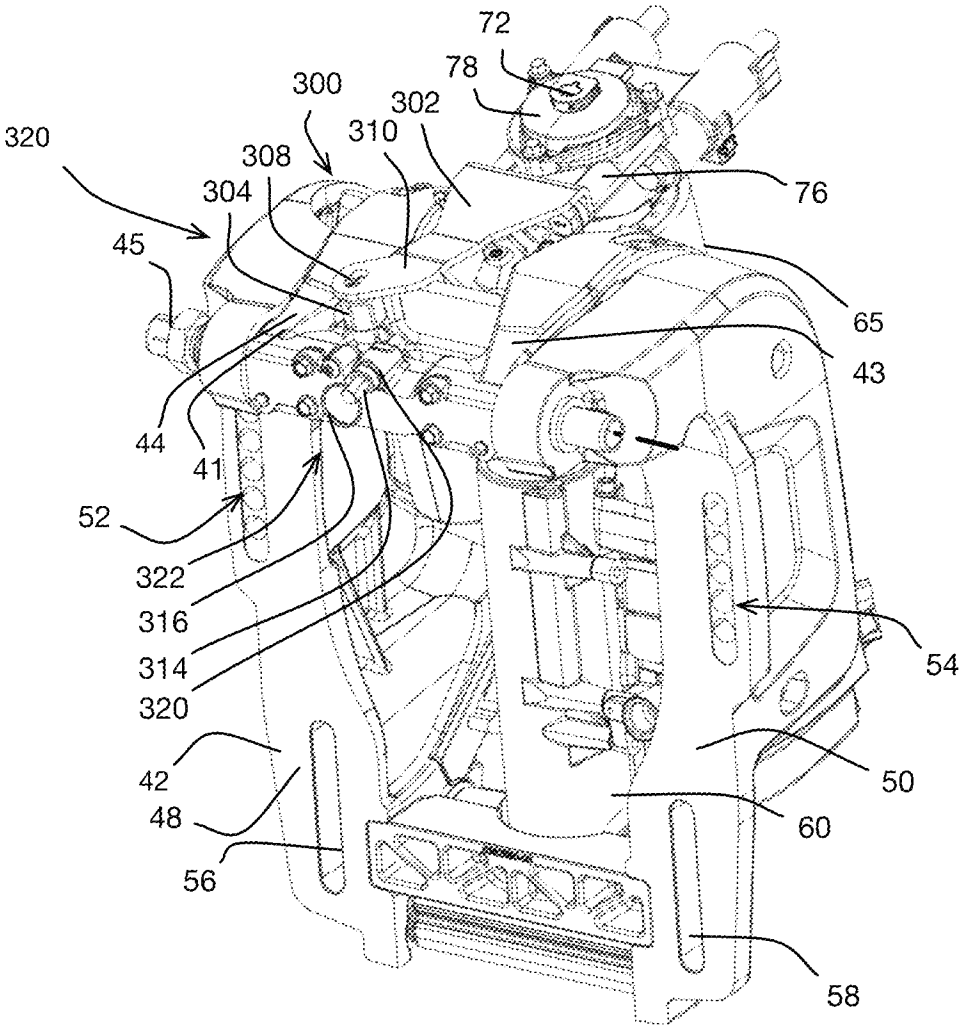
FIG. 20 is a perspective view taken from a front, left, top side of the bracket assembly of FIG. 18, showing the steering lock system in an unlocked position.

In the present implementation, removal of the locking pin 314 from the apertures 308, 312, or at least from the aperture 312, for example manually by an operator, disengages the steering lock bracket 302 from the pin-receiving member 304 and the swivel bracket 44, and thereby permits the steering lock bracket 302, and therefore also the motor assembly 14 and the motor mount 76, to pivot in either direction about the steering axis 16. This unlocked position is shown in FIG. 20.

The swivel bracket 44 further defines a storage aperture 320 in a forward-facing surface thereof between the arms 41 and 43. As shown in FIG. 20, the storage aperture 320 is sized to receive the locking pin 314 therein after the locking pin 314 has been removed from the apertures 308, 312, for storing the locking pin 314. The storage aperture 320 is similar in shape to the aperture 312. Thus, the locking pin 314 removably locks into the storage aperture 320 via the ball 319 once the locking pin 314 is inserted into the storage aperture 320. It is contemplated that the storage aperture 320 could be defined elsewhere in the swivel bracket 44 and/or other part(s) of the marine outboard motor 10. It is also contemplated that the storage aperture 320 could be omitted.

The locking pin 314 is one example of a locking member that could be used to provide the functionality described herein above. It is contemplated that a different locking member could be used instead of or in addition to the locking pin 314.

Modifications and improvements to the above-described implementations of the present technology may become apparent to those skilled in the art. The foregoing description is intended to be exemplary rather than limiting.

The invention claimed is:

1. A bracket assembly for a marine outboard motor, the marine outboard motor having a motor assembly and a propulsion unit operatively connected to the motor assembly to be driven by the motor assembly, the bracket assembly comprising:

a) a stern bracket adapted for mounting the marine outboard motor to a stern of a watercraft;

b) a swivel bracket pivotably connected to the stern bracket to pivot relative to the stern bracket about a tilt axis;

c) a motor mount pivotably connected to the swivel bracket to pivot relative to the swivel bracket about a steering axis, the motor mount being adapted to connect to the motor assembly;

d) a steering lock bracket operatively connected to the motor mount and being pivotable with the motor mount relative to the swivel bracket about the steering axis; and e) a locking member, the locking member being one of:

i) movably connected to the swivel bracket to move relative to the swivel bracket between an unlocked position and a locked position, the locking member in the unlocked position being positioned relative to the steering lock bracket so as to allow the motor mount to pivot about the steering axis, the locking member in the locked position cooperating with the steering lock bracket to prevent or limit pivoting of the motor mount about the steering axis, and ii) removably connected to both the swivel bracket and the steering lock bracket to prevent or limit pivoting of the motor mount about the steering axis, the locking member when removed from at least the swivel bracket allowing pivoting of the motor mount about the steering axis.

2. The bracket assembly of claim 1, wherein:

the locking member is removably connected to both the swivel bracket and the steering lock bracket to prevent or limit pivoting of the motor mount about the steering axis; and the locking member is a locking pin received in both: an aperture defined in the steering lock bracket, and an aperture defined in a part of the swivel bracket.

3. The bracket assembly of claim 2, wherein the part of the swivel bracket is a pin-receiving member removably connected to another part of the swivel bracket.

4. The bracket assembly of claim 3, wherein the pin-receiving member is threaded into a corresponding threaded recess defined in the other part of the swivel bracket.

5. The bracket assembly of claim 3, wherein the locking pin includes an auxiliary locking member removably engaging the pin-receiving member when the auxiliary locking member is received in the aperture of the pin-receiving member.

6. The bracket assembly of claim 2, wherein the pin-receiving member is disposed on one of a right side and a left side of a vertical longitudinal center plane of the bracket assembly and the steering lock bracket is disposed at least in part above the pin-receiving member when the motor mount is in a straight-ahead steering position.

7. The bracket assembly of claim 1, wherein:

the locking member is a lever; and the lever is pivotably connected to the swivel bracket to pivot relative to the swivel bracket about a lever axis between the unlocked position and the locked position.

8. The bracket assembly of claim 7, further comprising a lever guide defining a lever guide surface, the lever guide being connected to the swivel bracket, wherein:

the lever contacts the lever guide surface when in the locked position;

the lever contacts the lever guide surface when in the unlocked position; and the lever guide surface defines limits of pivoting of the lever about the lever axis.

9. The bracket assembly of claim 8, wherein the lever guide is disposed between the lever axis and the steering axis.

10. The bracket assembly of claim 8, wherein the lever guide surface defines the locked position and the unlocked position of the lever relative to the lever axis.

11. The bracket assembly of claim 8, wherein:

the lever guide surface defines a first recess, a second recess spaced from the first recess and a crest disposed between the first and second recesses, the crest extending toward the pivot axis;

the lever is received in the first recess when the lever is in the unlocked position; and the lever is received in the second recess when the lever is in the locked position.

12. The bracket assembly of claim 7, wherein the lever axis is one of parallel to and coaxial with the tilt axis.

13. The bracket assembly of claim 1, wherein:

the motor mount is an upper motor mount; and the bracket assembly further comprises a lower motor mount, the upper and lower motor mounts combining to connect to the motor assembly.

14. The bracket assembly of claim 7, wherein:

the lever defines a first prong and a second prong; and when the lever is in the locked position the steering lock bracket is disposed between the first and second prongs.

15. The bracket assembly of claim 7, further comprising a tilt axle extending through the swivel bracket and the stern bracket and defining the tilt axis, the lever being pivotally connected to the tilt axle.

16. A bracket assembly for a marine outboard motor, the marine outboard motor having a motor assembly and a propulsion unit operatively connected to the motor assembly to be driven by the motor assembly, the bracket assembly comprising:

a) a stern bracket adapted for mounting the marine outboard motor to a stern of a watercraft;

b) a swivel bracket pivotably connected to the stern bracket to pivot relative to the stern bracket about a tilt axis, the swivel bracket having a first aperture therein;

c) a motor mount pivotably connected to the swivel bracket to pivot relative to the swivel bracket about a steering axis, the motor mount being adapted to connect to the motor assembly;

d) a steering lock bracket operatively connected to the motor mount and being pivotable with the motor mount relative to the swivel bracket about the steering axis, the steering lock bracket defining a second aperture therethrough, the second aperture aligning with the first aperture when the motor mount is in a straight-ahead steering position; and e) a locking member being removably receivable in the first and second apertures when the second aperture is aligned with the first aperture, the locking member when received in the first and second apertures cooperating with the swivel bracket and the steering lock bracket to prevent or limit pivoting of the motor mount about the steering axis.

17. The bracket assembly of claim 16, wherein the locking member is a locking pin.

18. The bracket assembly of claim 16, wherein the swivel bracket includes a pin-receiving member, the pin-receiving member defining the first aperture therein, and the steering lock bracket is disposed at least in part above the pin-receiving member when the motor mount is in the straight-ahead steering position.

19. The bracket assembly of claim 18, wherein the locking member is a locking pin that includes a second locking member removably engaging the pin-receiving member when the locking pin is received in the aperture of the pin-receiving member.

20. The bracket assembly of claim 18, wherein the pin-receiving member is disposed on one of a right side and a left side of a vertical longitudinal center plane of the bracket assembly and the first and second apertures are aligned when the motor mount is in a straight-ahead steering position.

* * * * *